US006606968B2

(12) United States Patent
Iwama et al.

(10) Patent No.: US 6,606,968 B2
(45) Date of Patent: Aug. 19, 2003

(54) WATER HEATER UNIT

(75) Inventors: Kazushi Iwama, Fuji (JP); Akihito Yamashita, Fuji (JP)

(73) Assignee: Takagi Industrial Co., Ltd., Fuji (JP)

( * ) Notice: Subject to any disclaimer, the term of this patent is extended or adjusted under 35 U.S.C. 154(b) by 0 days.

(21) Appl. No.: 10/214,260

(22) Filed: Aug. 8, 2002

(65) Prior Publication Data

US 2003/0131804 A1 Jul. 17, 2003

(30) Foreign Application Priority Data

Jan. 11, 2002 (JP) ..... 2002-005148

(51) Int. Cl.[7] ..... F22B 5/02

(52) U.S. Cl. ..... 122/18.1; 122/14.2; 122/14.21; 122/14.22; 122/14.31

(58) Field of Search ..... 122/18.1, 18.2, 122/14.1, 14.2, 14.21, 14.3, 14.31

(56) References Cited

U.S. PATENT DOCUMENTS 4,158,438 A * 6/1979 Hapgood ..... 237/7
4,501,261 A * 2/1985 Tsutsui et al. ..... 126/351

FOREIGN PATENT DOCUMENTS

| | | | |
|---|---|---|---|
| JP | 62-258932 | * | 11/1987 |
| JP | 680375 | | 10/1994 |
| JP | 6-288538 | * | 10/1994 |
| JP | 7-42936 | * | 2/1995 |
| JP | 8313066 | | 11/1996 |
| JP | 1047655 | | 2/1998 |
| JP | 10-103685 | * | 4/1998 |
| JP | 10-300072 | * | 11/1998 |
| JP | 2897393 | | 3/1999 |
| JP | 11-344218 | * | 12/1999 |

* cited by examiner

*Primary Examiner*—Jiping Lu
(74) *Attorney, Agent, or Firm*—Connolly Bove Lodge & Hutz LLP

(57) ABSTRACT

There is provided a water heater unit realizing antifreezing of a water tube and the like of a heat exchanger without providing a backwind stopper on an exhaust tube. The water heater unit comprises a heat exchanger for heating water by a combustion heat of combustion means, water temperature sensors for detecting the temperatures of the water tube connected to the heat exchanger and an air supply fan for supplying air to a combustion chamber in which the combustion means is installed. When temperatures detected by the temperature sensors reach a temperature at which freezing of the heat exchanger is expected, the air supply fan is driven to supply air to the combustion chamber and the air is exhausted toward an exhaust port, thereby effecting heat exchange and antifreezing of the water tube.

18 Claims, 23 Drawing Sheets

WATER HEATER UNIT

BACKGROUND OF THE INVENTION

The invention relates to a water heater capable of preventing a water tube and the like of a heat exchanger from being frozen in a cold season, on a cold day, at a cold time (hereinafter referred to as a cold time).

In the case where a water heater unit having a heat source by combusting fuel gas is installed indoors, an exhaust gas is discharged outdoors using an exhaust tube which is provided with a backwind stopper for blocking off the entrance of an external backwind. At a cold time, the backwind stopper functions to prevent the water tube and the like provided around the heat exchanger from being frozen, and hence a heater is disposed on the water tube for preventing it from being frozen. A conventional antifreezing technique is disposed, for example in Japanese Patent Publication No. 6-80375, Japanese Patent Laid-Open Publication No. 10-47655, Japanese Patent No. 2, 897, 393, and Japanese Patent Laid-Open Publication No. 8-313066, and the like.

Meanwhile, it is not allowed to provide a backwind stopper on an exhaust tube in U.S.A., and hence a cold air caused by a backwind enters a heat exchanger at a cold time to cool down the heat exchanger, thereby producing freezing in the water tube. Even if the water tube is heated by heat of a heater installed on the water tube, freezing cannot be prevented in areas where an outside air temperature is extremely low.

BRIEF SUMMARY OF THE INVENTION

Accordingly, it is an object of the invention to provide a water heater unit capable of preventing a water tube and the like of a heat exchanger without providing a backwind stopper on an exhaust tube.

To achieve the above object, the water heater unit according to a first aspect of the invention comprises combustion means for combusting fuel, a combustion chamber incorporating the combustion means therein and having an exhaust port for guiding combusted exhaust air produced in the combustion chamber to outside air, a heat exchanger provided with a water tube through which water flows and heating water which flows through the water tube by heat produced by combustion in the combustion means, temperature sensors attached to the water tube connected to the heat exchanger for detecting temperatures of the water tube, and an air supply fan for supplying air to the combustion chamber in which the combustion means is installed, characterized in that the air supply fan is driven to supply air to the combustion chamber when the temperatures detected by the temperature sensors reach a temperature at which freezing of water inside the water tube of the heat exchanger is expected, and the air from the combustion chamber is discharged toward the exhaust port so that the exhaust air warms the water tube.

The water heater unit according to a second aspect of the invention is characterized in that the first aspect of the invention further comprises a heater installed on the water tube of the heat exchanger for heating the water tube, wherein the heater is energized to heat the water tube when the temperatures detected by the temperature sensors reach a temperature at which freezing of water inside the water tube of the heat exchanger is expected.

The water heater unit according to a third aspect of the invention is characterized in that in the first aspect of the invention an outlet side water temperature of the water tube detected by the water temperature sensor of the first aspect of the invention is lower than the temperature of inlet side water temperature of the water tube detected by the water temperature sensor, the air supply fan is rotated.

The water heater unit according to a fourth aspect of the invention is characterized in that the first aspect of the invention further comprises a heater installed on the water tube of the heat exchanger for heating the water tube, and a wind pressure sensor installed at a part capable of detecting a backwind which enters the exhaust port, wherein when the wind pressure sensor detects a backwind exceeding a prescribed value, the air supply fan is stopped and the heater is energized so as to heat the water tube.

The water heater unit according to a fifth aspect of the invention is characterized in that in the first aspect of the invention the speed of rotation of the air supply fan of the first aspect of the invention is increased or decreased in response to the magnitude of a backwind which flows into an exhaust path through the exhaust port.

The water heater unit according to a sixth aspect of the invention is characterized in that the first aspect of the invention further comprises an air sensor installed on a part capable of detecting the volume of air which flows into the combustion chamber wherein the volume of air detected by the air sensor is controlled to be equal to a set volume of air by increasing or decreasing the speed of rotation of the air supply fan in response to the volume of air detected by the air sensor.

The water heater unit according to a seventh aspect of the invention is characterized in that the first aspect of the invention further comprises an air sensor installed on a part capable of detecting the volume of air which flows into the combustion chamber wherein the volume of air detected by the air sensor is controlled to be equal to a set volume of air by increasing or decreasing the speed of rotation of the air supply fan in response to the volume of air detected by the air sensor and the temperatures detected by the temperature sensors.

The water heater unit according to an eighth aspect of the invention is characterized in that in the first aspect of the invention the speed of rotation of air supply fan of the first aspect of the invention is increased or decreased in response to the temperatures detected by the temperature sensors.

The water heater unit according to a ninth aspect of the invention is characterized in that the first aspect of the invention further comprises differential pressure detection means installed on a part capable of detecting the difference of pressures between the interior of the housing of the water heater unit and the suction part of the air supply fan, wherein the speed of rotation of the air supply fan is controlled in a manner that the difference of pressures detected by the differential pressure detection means is equal to a predetermined difference of pressures.

The water heater unit according to a tenth aspect of the invention is characterized in that the first aspect of the invention further comprises differential pressure detection means installed on a part capable of detecting the difference of pressures between the interior of the housing of the water heater unit and the suction part of the air supply fan, wherein the speed of rotation of the air supply fan is controlled in a manner that the difference of pressures detected by the differential pressure detection means is equal to a predetermined difference of pressures in response to the difference of pressures detected by the differential pressure detection means and temperatures detected by the temperature sensors.

The water heater unit according to the eleventh aspect of the invention is characterized in that in the first aspect of the invention a load applied to exhaust air is discriminated by a driving current value while a driving voltage of a motor for driving the air supply fan and the speed of rotation of the air supply fan are respectively held constant, and wherein the speed of rotation of the air supply fan is controlled in a manner that it reaches a set current value in response to the load applied to the exhaust air.

The water heater unit according to the twelfth aspect of the invention is characterized in that in the first aspect of the invention a load applied to exhaust air is discriminated by a driving current value while a driving voltage of a motor for driving the air supply fan and the speed of rotation of the air supply fan are respectively constant, and wherein the speed of rotation of the air supply fan is controlled in a manner that it reaches a set current value in response to the load applied to the exhaust air and temperatures detected by the temperature sensors.

The water heater unit according to the thirteenth aspect of the invention is characterized in that in the second aspect of the invention the heater heats water inside the water tube when the temperature detected by the temperature sensor for detecting inlet side water temperature reaches close to a freezing temperature.

The water heater unit according to the fourteenth aspect of the invention is characterized in that in the fourth aspect of the invention the wind pressure sensor is attached to the combustion chamber while intervening a detection member.

The water heater unit according to the fifteenth aspect of the invention is characterized in that in the sixth aspect of the invention the air sensor is installed on a bypass provided between an upstream side and a downstream side of the combustion chamber.

The water heater unit according to the sixteenth aspect of the invention is characterized in that in the seventh aspect of the invention the air sensor is installed on a bypass provided between an upstream side and a downstream side of the combustion chamber.

The water heater unit according to the seventeenth aspect of the invention is characterized in that in the ninth aspect of the invention the differential pressure detection means is installed between the interior of the housing of the water heater unit and the suction part of the air supply fan.

The water heater unit according to the eighteenth aspect of the invention is characterized in that in the tenth aspect of the invention the differential pressure detection means is installed between the interior of the housing of the water heater unit and the suction part of the air supply fan.

With the construction of the water heater unit of the invention, if the freezing of water is expected at a cold time, the water tube is heated by a heater to introduce an indoor air into the combustion chamber of the heat exchanger so as to exhaust the indoor air through the exhaust port so that it can function as a substantial backwind stopper, thereby preventing the water tube from being frozen.

The objects, characteristics, effects and the like of the invention become clearer with reference to the following first to fifth embodiments of the invention, the detail description of the invention and the attached drawings.

BRIEF DESCRIPTION OF THE SEVERAL VIEWS OF THE DRAWING

FIG. 3 is a view showing a heat exchanger and the like;

FIG. 4 is a view showing a heat exchanger and the like;

DETAILED DESCRIPTION OF THE INVENTION

Working examples of the invention are now described in detail with reference to the attached drawings.

FIRST EMBODIMENT

Figure 1:
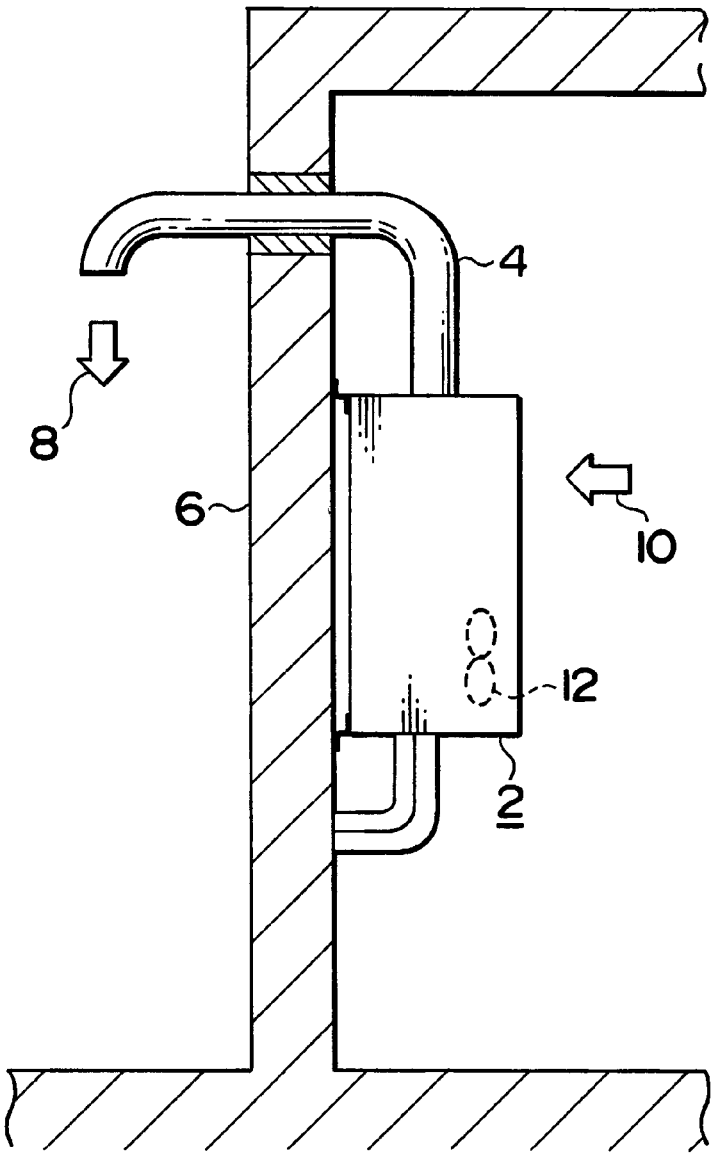
FIG. 1 is a view showing a configuration of installation of a water heater unit according to a first embodiment of the invention.
Figure 2:
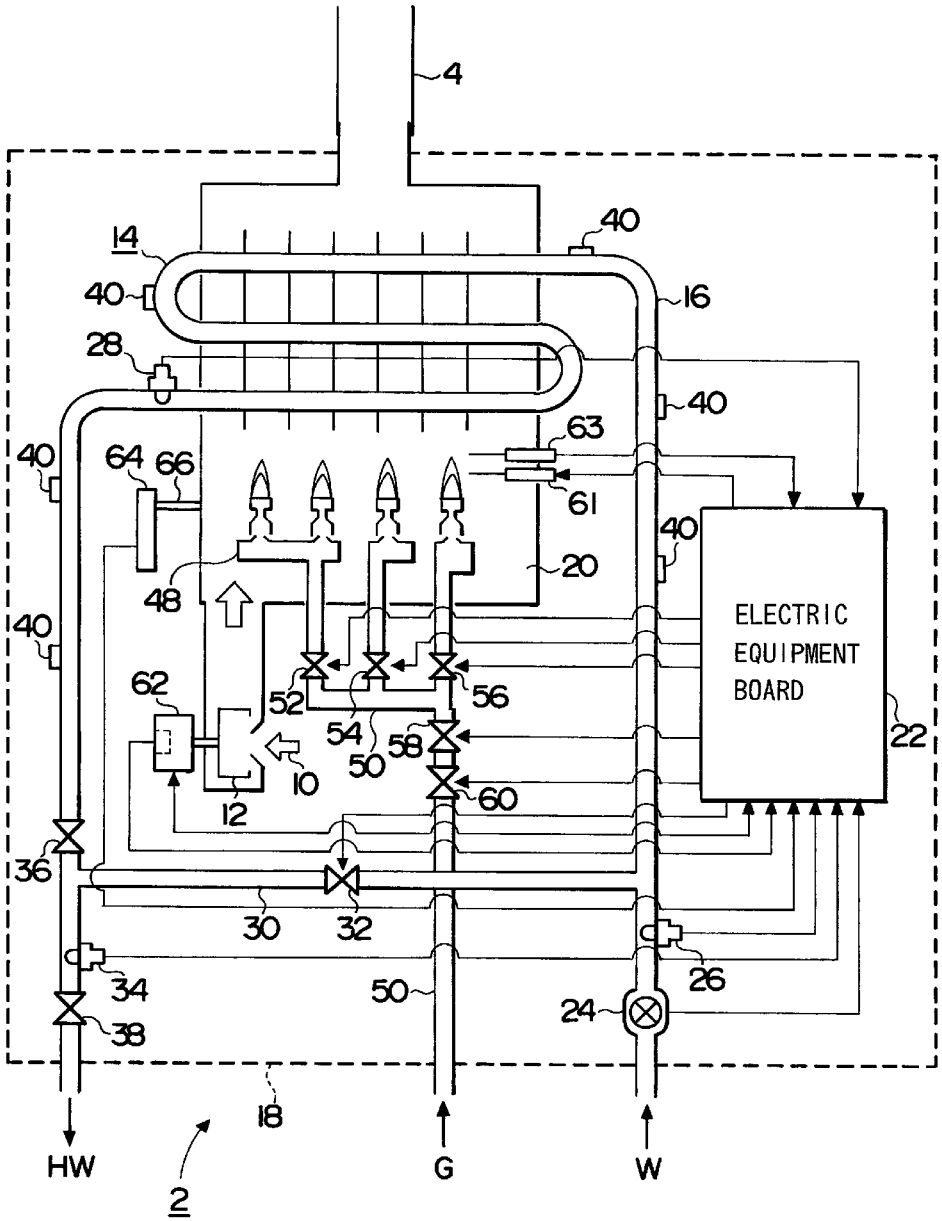
FIG. 2 is view showing the water heater unit according to the first embodiment of the invention.
Figure 3:
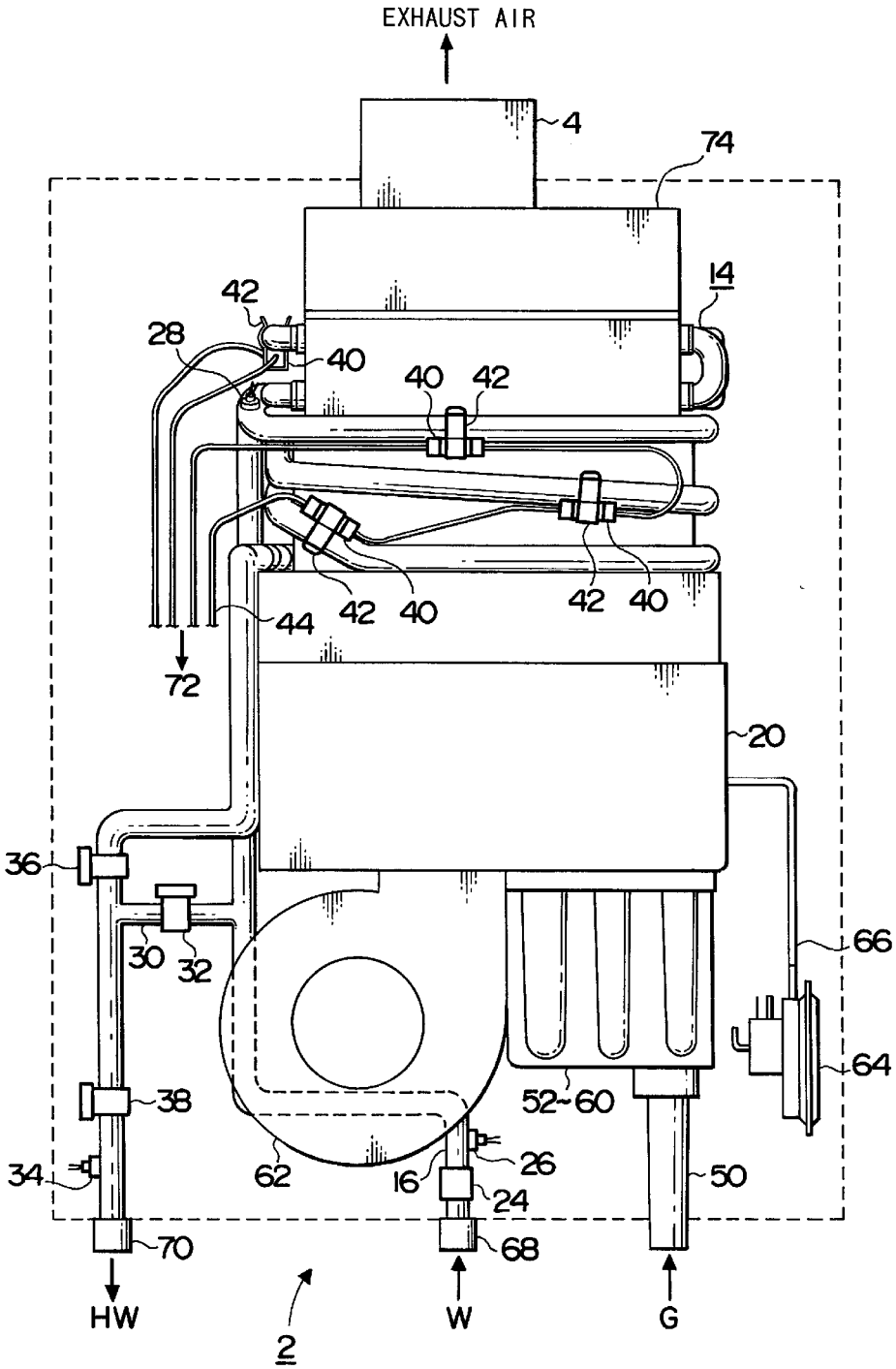
Figure 4:
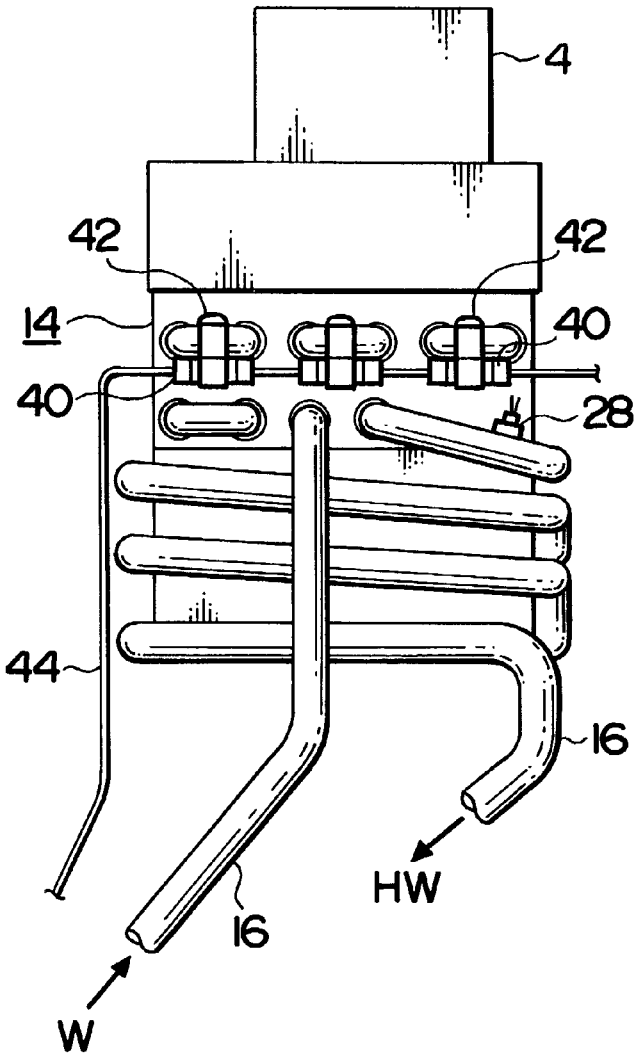
Figure 5:
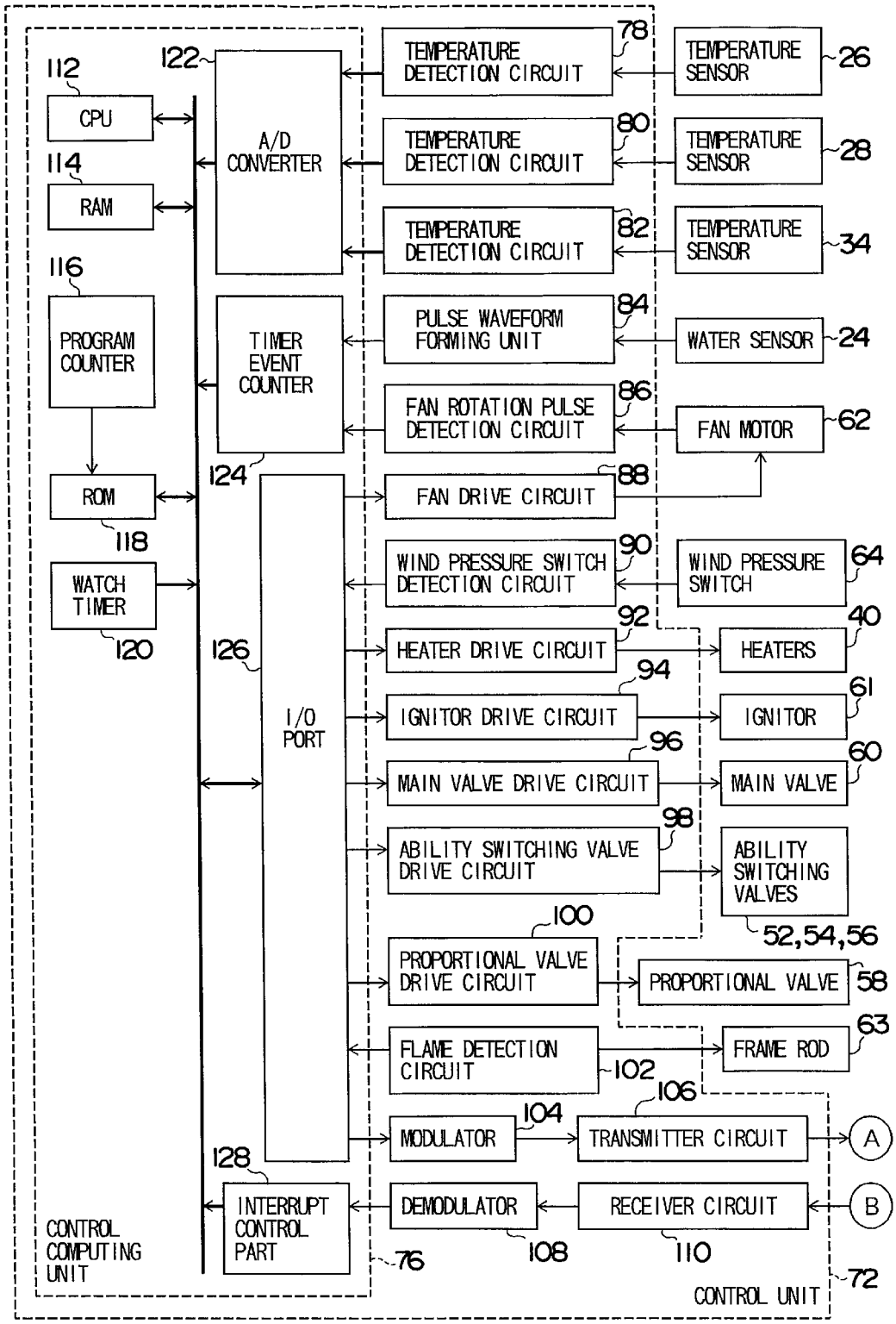
FIG. 5 is a block diagram showing a control unit of the water heater unit.
Figure 6:
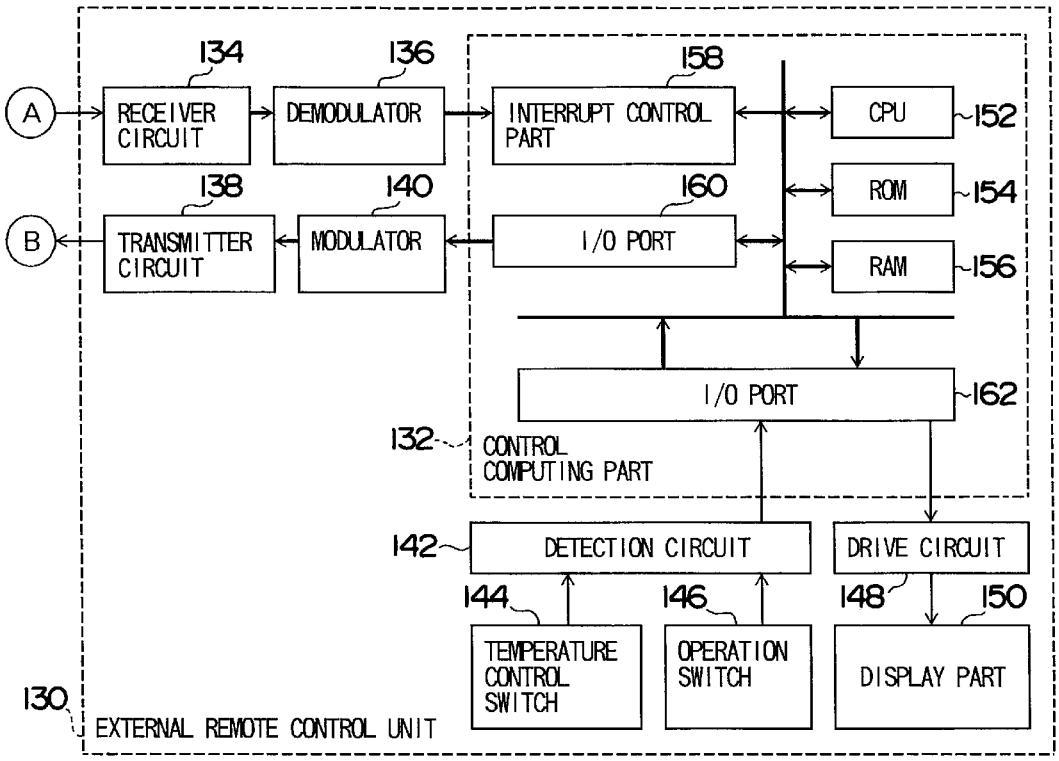
FIG. 6 is a block diagram showing an external remote control unit.

FIGS. 1 to 6 show a water heater unit according to the first embodiment of the invention, wherein FIG. 1 shows a configuration of installation of the water heater unit, FIG. 2 shows a full disclosure of the water heater unit, FIGS. 3 and 4 show a heat exchanger, FIG. 5 shows a control unit and FIG. 6 shows an external remote control unit. In FIGS. 5 and 6, depicted by A and B are connection symbols.

As shown in FIG. 1, a water heater unit 2 is installed indoors, and an exhaust tube 4 penetrates a wall part 6 and directs from an indoor side to an outdoor side of the wall part 6 so that exhaust gas 8 produced in the water heater unit 2 is exhausted outdoors through the exhaust tube 4. At this time, a combustion air is sucked from the indoor side. When an air supply fan 12 is rotated when a backwind blows, the entrance of the backwind is prevented so as to heat a heat exchanger 14 and a water tube 16 installed inside the water heater unit 2 by indoor air 10 (see FIG. 2).

The water heater unit 2 has therein, as shown in FIG. 2, the heat exchanger 14, the water tube 16, a combustion chamber 20, an electric equipment board 22 and the like which are respectively installed in a housing 18, a water sensor 24, a temperature sensor 26 for detecting an inlet side water temperature, a temperature sensor 28 for detecting an outlet side hot water temperature, a bypass tube 30, a bypass valve 32, a temperature sensor 34 for detecting a temperature of the mixture of water and hot water, a water heater valve 36, a water control valve 38 which are respectively installed on the water tube 16, and multiple heaters 40 for heating the water tube 16. Clean water W is supplied to the water tube 16 and hot water HW is discharged from the water control valve 38 side.

Burners 48 are installed in the combustion chamber 20 and ability switching valves 52, 54, 56 for switching the amount of fuel to be combusted, a proportional valve 58 and a main valve 60 are installed on a fuel supply tube 50 for supplying fuel to the burners 48, and fuel gas G is supplied to the fuel supply tube 50. An ignitor 61 serving as ignition means and a flame rod 63 serving as flame detection means are respectively installed in the vicinity of the burners 48. The air supply fan 12 is installed in the combustion chamber 20, and a fan motor 62 is connected to the air supply fan 12 wherein the indoor air 10 is taken in the combustion chamber 20 when the fan motor 62 is rotated. A wind pressure switch 64 serving as a wind pressure sensor for detecting the closing of the exhaust tube 4 from the increase of the wind pressure by the air supply fan 12 is attached to the combustion chamber 20 via a detection tube 66. According to the first embodiment, the detection tube 66 is employed as a detection member, however, other means may be employed as the detection member.

Further, as shown in FIG. 3, a water supply port 68 is formed on the water inlet side of the water tube 16, and the hot water discharge port 70 is formed on the hot water outlet side. The multiple heaters 40 are fixed to the water tube 16 by heater fixed plates 42, and lead lines 44 of the multiple heaters 40 are connected to a control unit 72 which is mounted on the electric equipment board 22. The exhaust tube 4 is attached to an exhaust air collection board 74 provided on the upper portion of the combustion chamber 20. Further, as shown in FIG. 4, the multiple heaters 40 are also fixed to a wall part of the heat exchanger 14, namely, a thin part of the heat exchanger 14 by the heater fixed plates 42.

The control unit 72 mounted on the electric equipment board 22 comprises, as shown in FIG. 5, temperature detection circuits 78, 80, 82, a pulse waveform forming unit 84, a fan rotational pulse detection circuit 86, a fan drive circuit 88, a wind pressure switch detection circuit 90, a heater drive circuit 92, an ignitor drive circuit 94, a main valve drive circuit 96, an ability switching valve drive circuit 98, a proportional valve drive circuit 100, a flame detection circuit 102, a modulator 104, a transmitter circuit 106, a demodulator 108 and a receiver circuit 110 as well as a control computing unit 76. The control computing unit 76 comprises a CPU 112, a RAM 114, a program counter 116, a ROM 118, a watch timer 120, an A/D converter 122, a timer event counter 124, an I/O port 126, and an interrupt control part 128. The program counter 116 is used for counting locations for programming, namely, the address of next instruction so as to operate the CPU 112, and the timer event counter 124 is used for detecting the speed of rotation of the fan motor 62.

An external remote control unit 130 connected to the control unit 72 comprises, as shown in FIG. 6, a receiver circuit 134, a demodulator 136, a transmitter circuit 138, a modulator 140, a detection circuit 142, a temperature control switch 144, an operation switch 146, a drive circuit 148 and a display part 150, as well as a control computing part 132. The control computing part 132 comprises a CPU 152, a ROM 154, a RAM 156, an interrupt control part 158, and I/O ports 160, 162.

Figure 7:
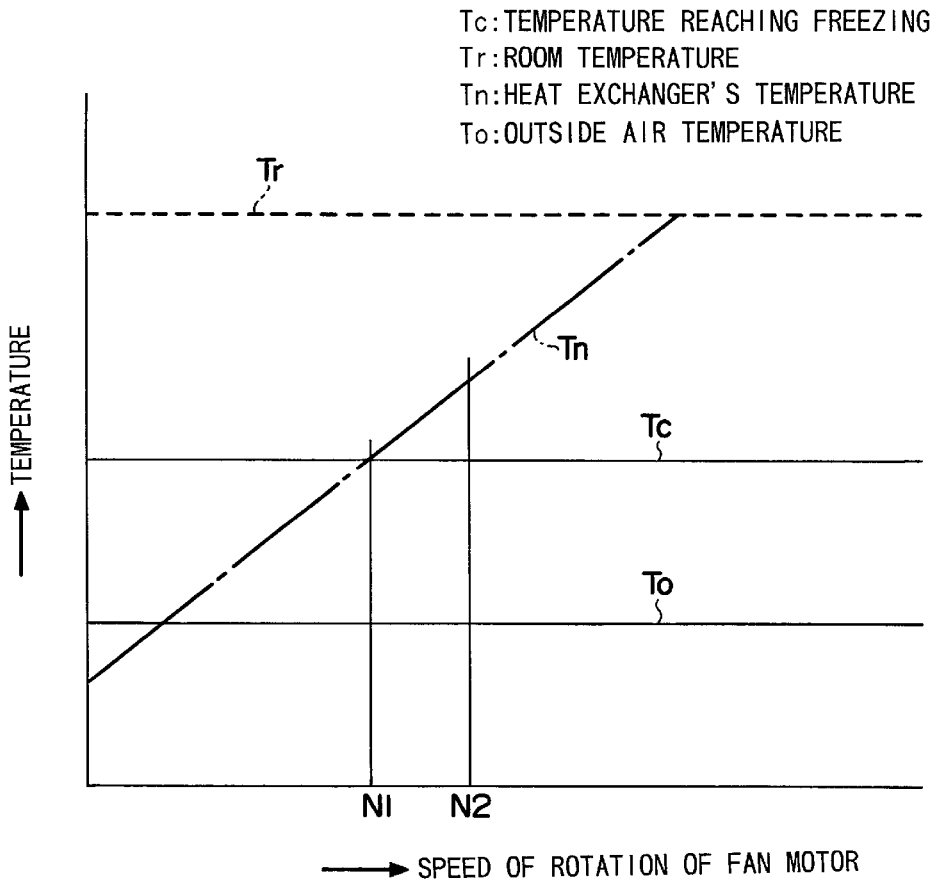
FIG. 7 is a view showing antifreezing operation.

An operation of the water heater unit is described next. FIG. 7 shows a method of deciding speed of rotation of a fan motor for antifreezing, wherein the speed of rotation of the fan is increased while a velocity of the backwind, an outside air temperature, a room temperature are respectively constant, so that a temperature (heat exchanger's temperature) detected by a temperature sensor 28 for detecting the hot water outlet side temperature of the water tube 16 is increased to become higher than a freezing temperature, thereby deciding the speed of rotation of the fan motor for effecting antifreezing. In FIG. 7, depicted by Tr is a room temperature, Tn is a heat exchanger's temperature, Tc is a temperature reaching freezing, To is an outside air temperature, N1 is a speed of rotation of the fan motor which does not reach freezing, N2 is speed of rotation having slight time to reach freezing, and the speed of rotation N2 is defined as that at the time of antifreezing operation.

Figure 8:
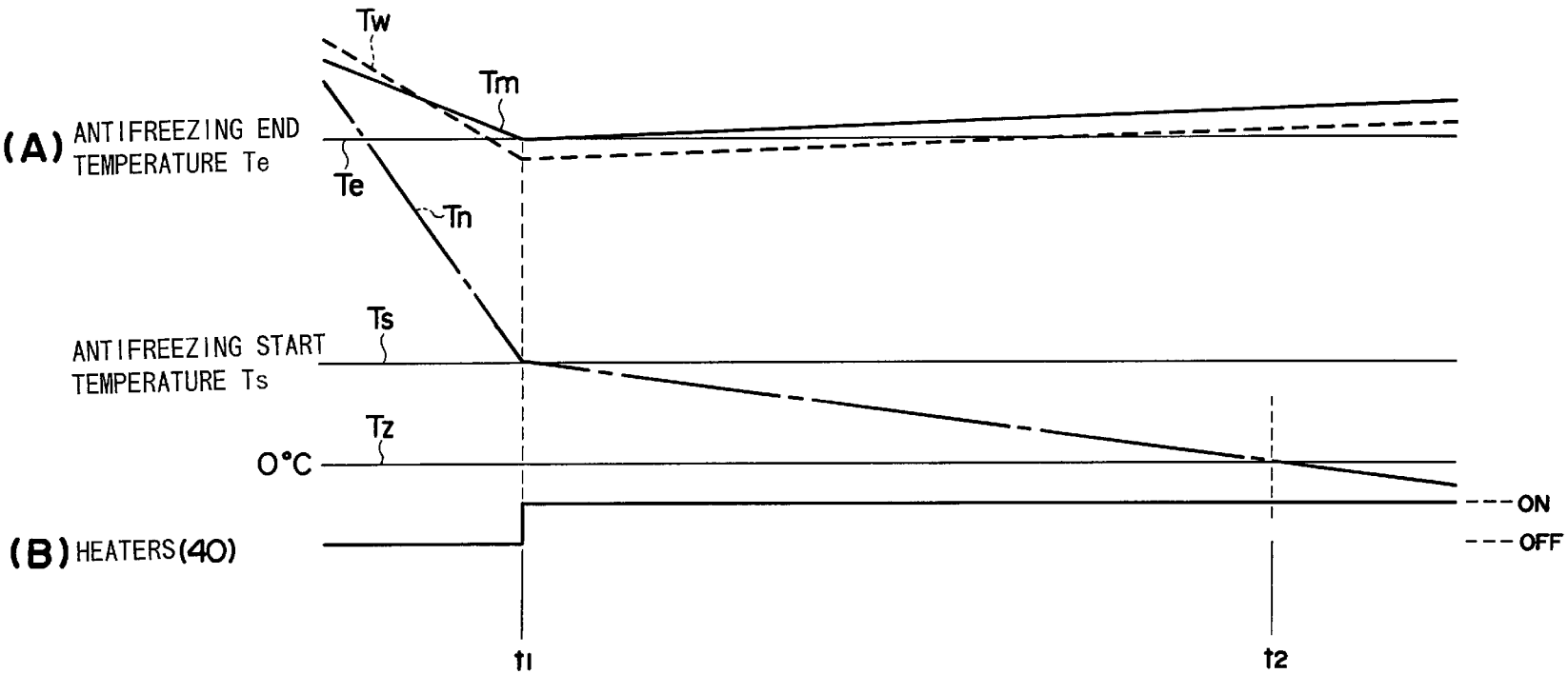
FIG. 8 is a view showing antifreezing operation by a heater alone.

FIG. 8 shows a case where antifreezing operation is effected by use of the multiple heaters 40 alone, In (A), depicted Tw is an inlet side water temperature, Tm is a temperature of mixture of water and hot water, Tn is a heat exchanger's temperature, Ts is an antifreezing start temperature, Te is an antifreezing end temperature, and Tz (=0° C.) is a freezing temperature. (B) shows ON and OFF states of electric conduction or energization of the multiple heaters 40. That is, at time $t_1$, a backwind blows through the exhaust tube 4 so that the heat exchanger's temperature Tn is decreased while if the heat exchanger's temperature Tn becomes not more than the antifreezing start temperature Ts, the multiple heaters 40 are turned on. Since the backwind from the exhaust tube 4 exceeds a heating ability of the multiple heaters 40 during the time interval between $t_1$ to $t_2$, the heat exchanger's temperature Tn is decreased so that freezing starts at time $t_2$. After time $t_2$, the heat exchanger's temperature Tn is decreased until the backwind and the heating ability of the multiple heaters 40 are balanced with each other.

Figure 9:
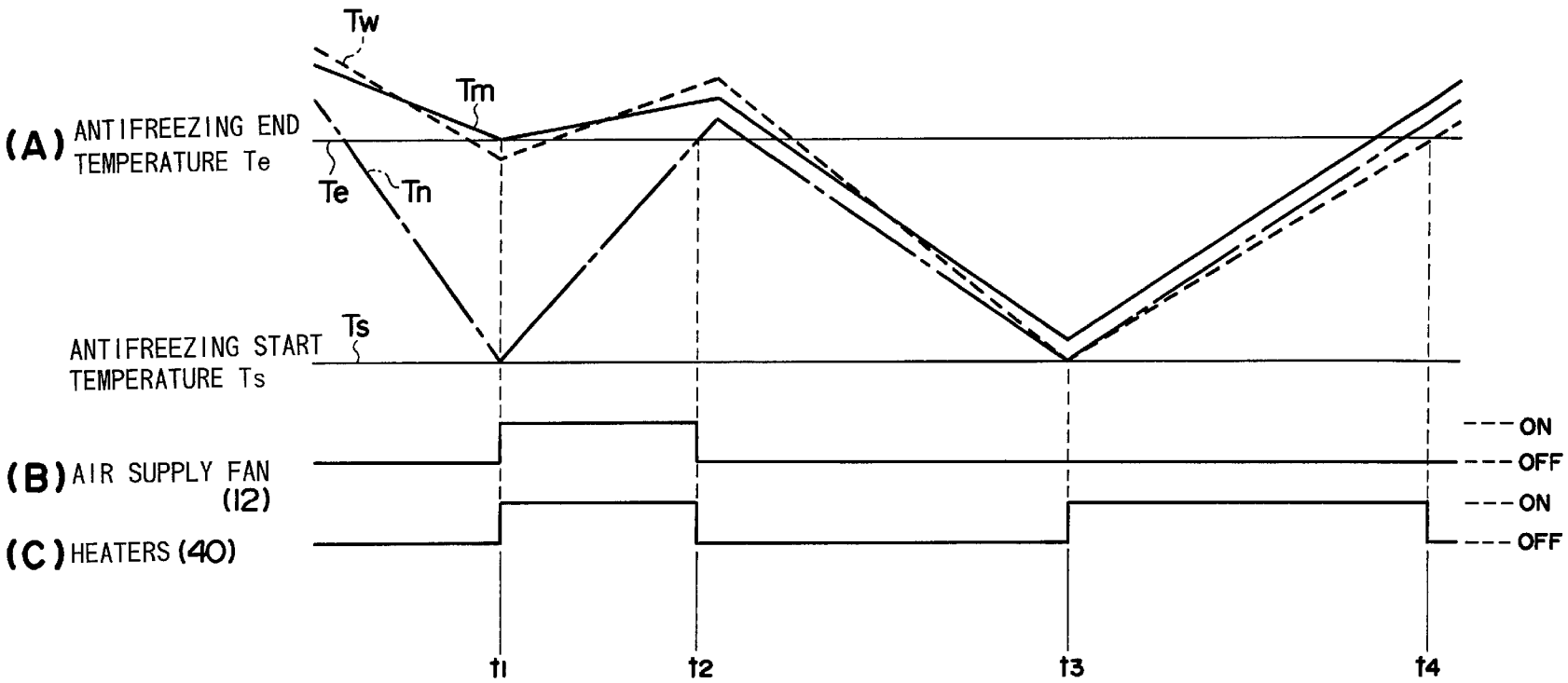
FIG. 9 is a view showing antifreezing operation.

FIG. 9 shows a case where an antifreezing operation is effected by use of both the multiple heaters 40 and the air supply fan 12. In (A), depicted Tw is an inlet side water temperature, Tm is a temperature of mixture of water and hot water, Tn is a heat exchanger's temperature, Ts is an antifreezing start temperature, Te is an antifreezing end temperature. (B) shown ON and OFF states of the rotation of the air supply fan 12. (C) shows ON and OFF states of electric conduction or energization of the multiple heaters 40. That is, since the heat exchanger's temperature Tn is not more than the inlet side water temperature Tw by a value exceeding a prescribed value at time $t_1$, both the multiple heaters 40 and the air supply fan 12 are turned on. When the temperature sensor 28 detects the antifreezing end temperature Te at time $t_2$, both the multiple heaters 40 and the air supply fan 12 are turned off. When there is no difference between the heat exchanger's temperature Tn and the inlet side water temperature Tw or the inlet side water temperature Tw is lower than the heat exchanger's temperature Tn at time $t_3$, the multiple heaters 40 alone are turned on. When the temperature sensor 28 detects the antifreezing end temperature Te at time $t_4$, the multiple heaters 40 are turned off Further, there is a case where the exhaust port of the exhaust tube 4 is closed by a foreign matter or covered with snow and the like or it can not exhaust air by a backwind. In such a case, the pressure inside the combustion chamber 20 is increased by the air supply fan 12, and the wind pressure switch 64 is operated. At this time, the operations of both the burners 48 and the air supply fan 12 are prohibited and an alarm is notified by the display part 150 of the external remote control unit 130 so that the multiple heaters 40 are turned on or off based on the temperature detected by the temperature sensor 26 or the temperature sensor 28, thereby preventing water tube 16 from being frozen.

Figure 10:
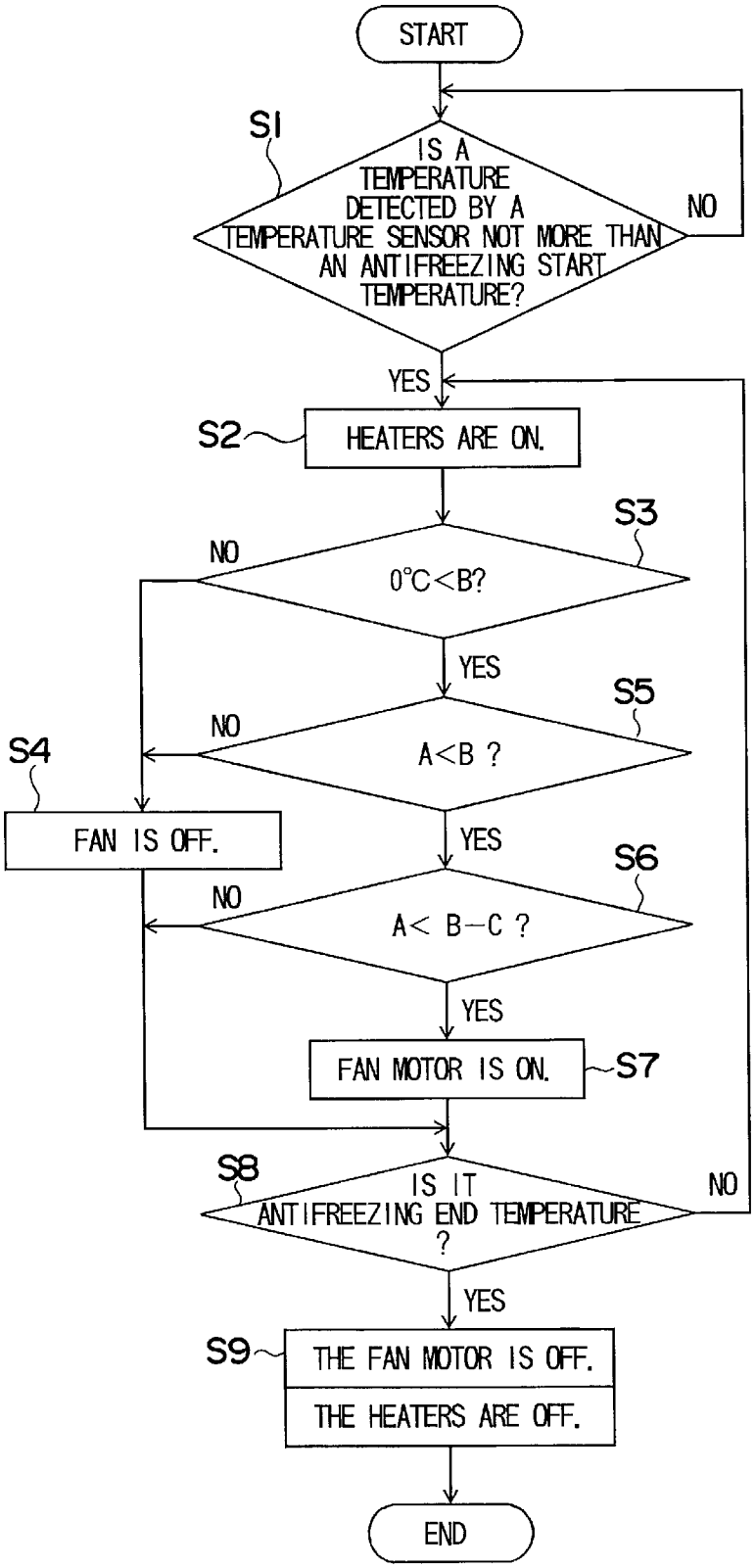
FIG. 10 is a flow chart showing antifreezing operation.

FIG. 10 shows an antifreezing control operation. In FIG. 10, depicted by A is a temperature detected by the temperature sensor 28 which is extremely or frequently susceptible to a cold wind which blows into the exhaust tube 4, namely, the temperature detected by the temperature sensor 28 for detecting the temperature at the hot water outlet side of the water tube 16, B is a temperature detected by the temperature sensor 26 which is hardly susceptible to a cold wind which blows into the exhaust tube 4, namely, the temperature detected by the temperature sensor 26 for detecting the inlet side water temperature Tw, and C is a constant.

In step S1, it is decided whether the temperature detected by any of the temperature sensors 26, 28 and 34 is not more than the antifreezing start temperature Ts or not. That is, when the temperature sensors 26, 28 and 34 detects the temperature which is not more than the antifreezing start temperature Ts in step S1, an antifreezing operation is started in step S2, thereby turning on the multiple heaters 40. It is decided whether the expression of 0° C.<B is established or not in step S3 At this time, if the inlet side water temperature Tw is not more than 0° C., a program goes to step S4 where the air supply fan 12 is not rotated.

It is decided whether the expression A<B is established or not in step S5, wherein when the temperature detected by the temperature sensor 26 is lower than that of the temperature sensor 28, the program goes to step S4 where the air supply fan 12 is not rotated in the same manner as the step S3. That is, the reason why the air supply fan 12 is not operated is that the water heater unit is cooled so that no antifreezing effect is obtained, and at this time it is decided that the room temperature is low so that the air supply fan 12 is rendered in a standstill. Accordingly, the antifreezing operation is effected by multiple heaters 40 alone.

It is decided whether the expression of A<B−C is establish or not in step S6. That is, the temperature detected by the temperature sensor 28 is not more than that of the temperature sensor 26 by a value exceeding a prescribed value, it is decided that the temperature at the upper portion of the heat exchanger 14 is decreased owing to the backwind. At this time, the program goes to the step S7 where the fan motor 62 is operated to operate the air supply fan 12, thereby blocking off the backwind while the multiple heaters 40 are turned on to prevent freezing. If the expression of A<B−C is not established in step S6, the fan motor 62 is stopped so as to render the multiple heaters 40 alone to remain in an antifreezing operation state.

When any of the temperature sensors 26, 28 and 34 detects the antifreezing end temperature Te in step S8, the program goes to step S9 where the operations of both the fan motor 62 and multiple heaters 40 are stopped, thereby terminating the antifreezing operation. Meanwhile, if any of the temperature sensors 26, 28 and 34 does not detect the antifreezing end temperature Te in step S8, the program is returned to step S2 where the fan motor 62 are repetitively turned on or off to effect an antifreezing operation in accordance with decision conditions in steps S3, S5, and S6 while the multiple heaters 40 are held operated.

Figure 11:
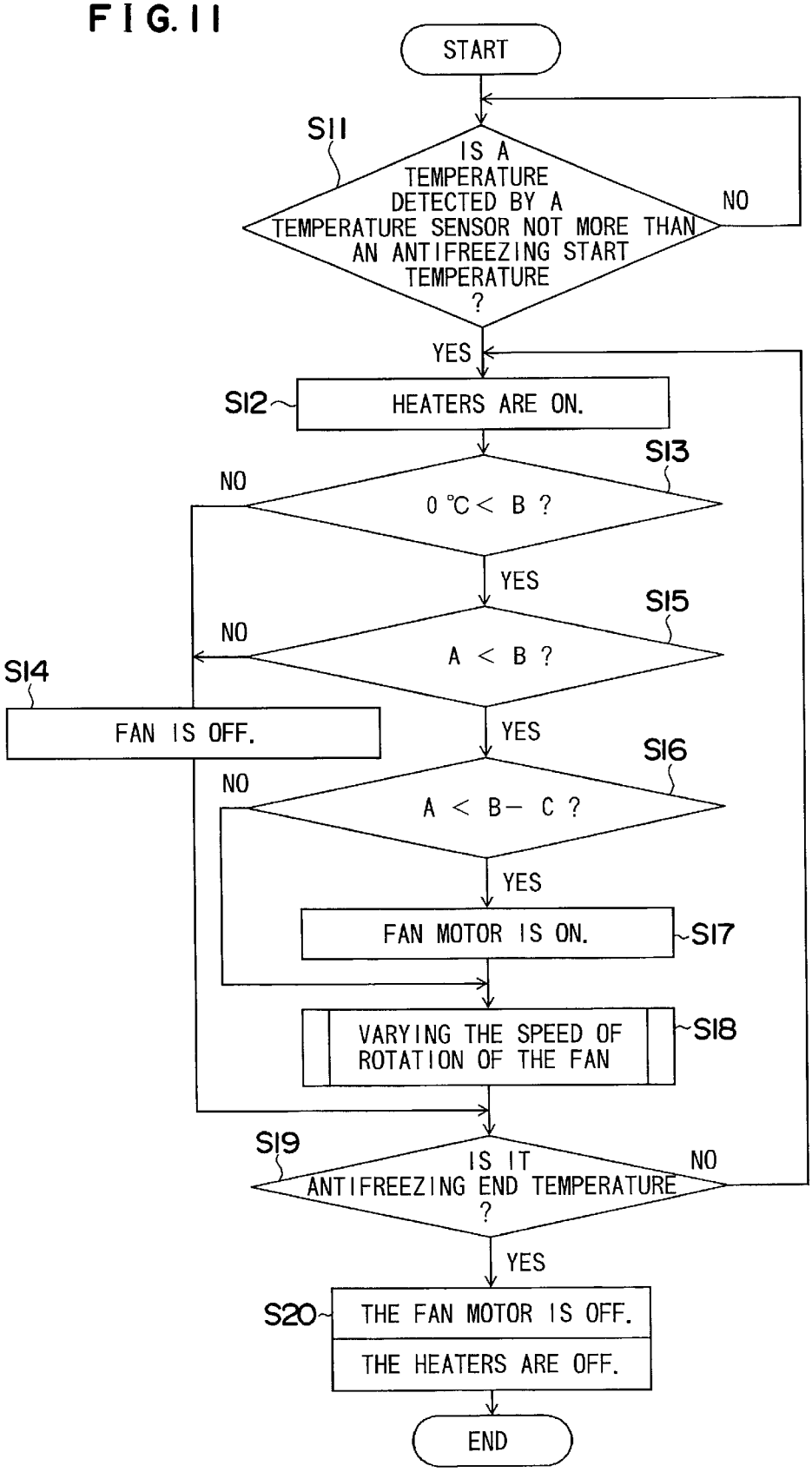
FIG. 11 is a flow chart showing antifreezing operation.

FIG. 11 shows a modification of control operation of the invention as a whole. In the modification, step S11 to step S17, and step S19 and step S20 are the same as step S1 to step S7, step S8 and step S9 in the first embodiment, and further a routine for varying the speed of rotation of the fan is inserted as a new step S18 so as to realize a more accurate antifreezing control. The detail of the routine of this variation of the speed of rotation of the fan motor is described in detail in the following second to fifth embodiments of the invention.

SECOND EMBODIMENT

Figure 12:
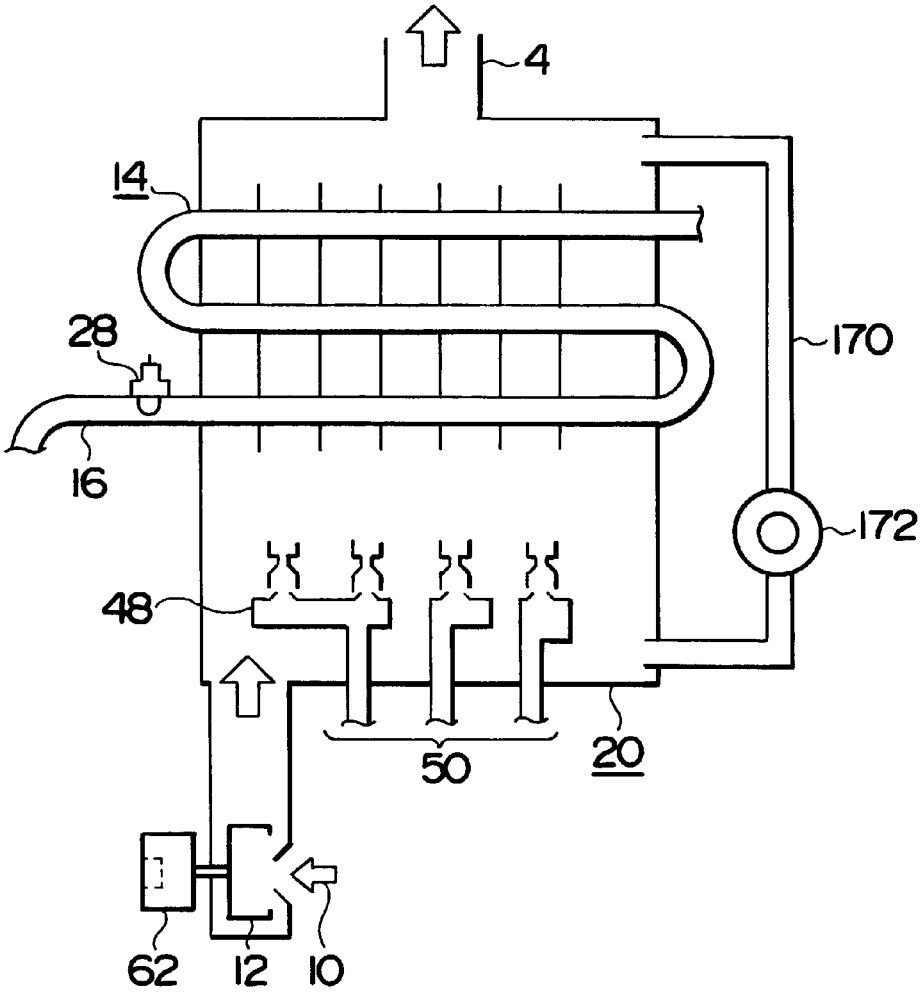
FIG. 12 is a view showing a water heater unit according to a second embodiment of the invention.

FIG. 12 shows the second embodiment of the water heater unit of the invention. In the second embodiment, a bypass 170 is provided between an upstream side and a downstream side of a combustion chamber 20, namely, between an exhaust side reaching an exhaust tube 4 and burners 48. An air sensor 172 serving as means for detecting a backwind which acts on the exhaust tube 4 is installed on the bypass 170, and an output of the air sensor 172 is applied to a control unit 72. That is, the rotation of a fan motor 62 is controlled by the output of the air sensor 172. In the second embodiment, although the bypass 170 is installed as a component for detecting the volume of air flowing toward the combustion chamber 20, it may be possible to install a part capable of detecting the volume of air which flows toward the combustion chamber 20 except the bypass 170.

With the construction of the water heater unit according to the second embodiment of the invention, when a backwind acts on the exhaust tube 4, an exhaust load increases while the volume of air flowing through the bypass 170 is reduced so that the reduction of volume of air can be detected by the air sensor 172. It is decided that there is a backwind by the output of the air sensor 172 when the volume of air is reduced, thereby increasing the speed of rotation of the fan so as to reach a predetermined volume of air. Further, when the volume of air is increased, the speed of rotation is decreased.

Figure 13:
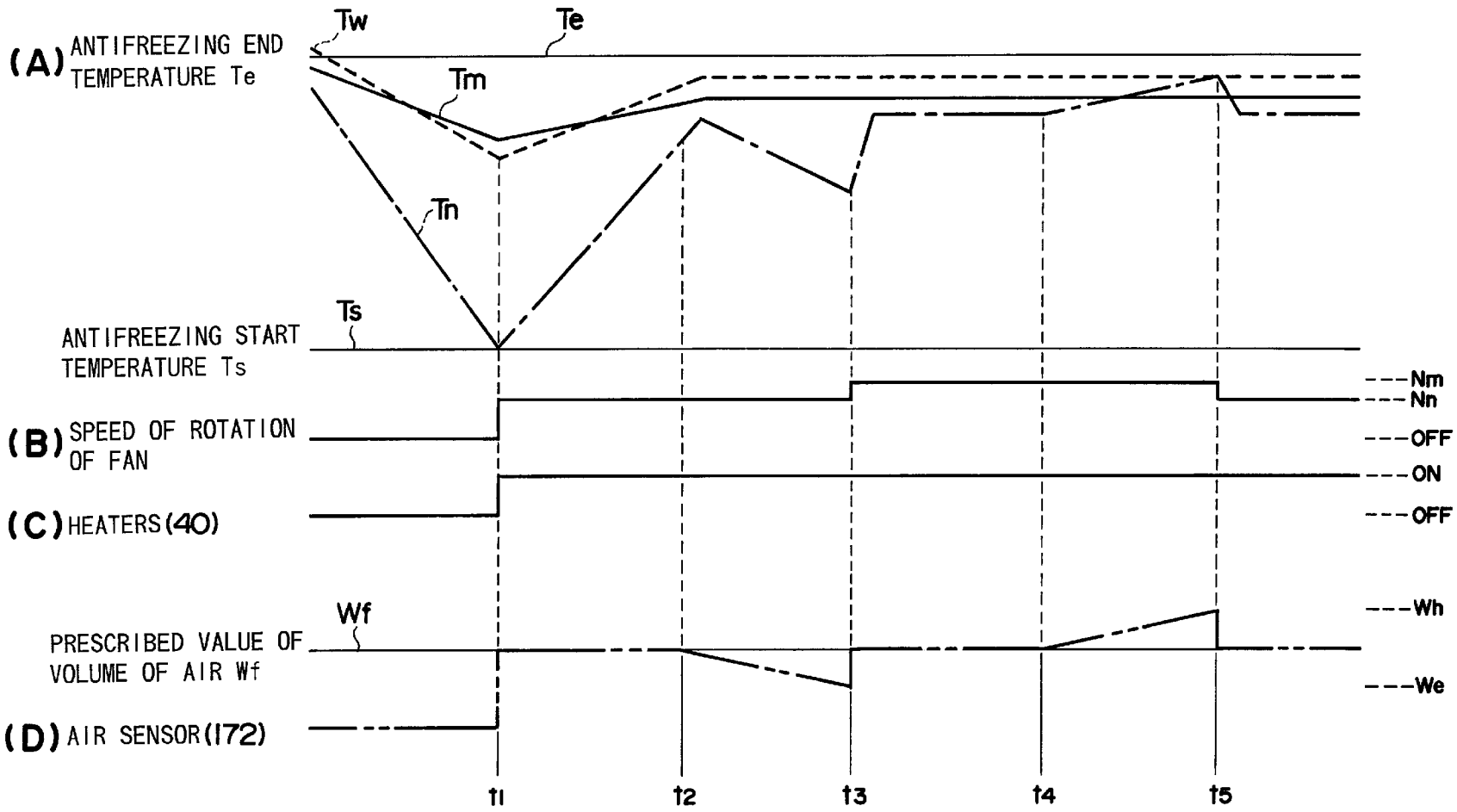
FIG. 13 is a view showing antifreezing operation according to the second embodiment of the invention.

FIG. 13 shows a transition of variation of temperatures during an antifreezing operation. In (A), depicted Tw is an inlet side water temperature, Tm is a temperature of mixture of water and hot water, Tn is a heat exchanger's temperature, Ts is an antifreezing start temperature, and Te is an antifreezing end temperature. (B) shows switching between the speed of rotations 0, Nn, and Nm(>Nn) of the air supply fan 12, (C) shows ON and OFF states of electric conduction or energization of the multiple heaters 40. (D) shows a transition of a detected output of an air sensor 172, wherein depicted by Wf is a prescribed value of the volume of air. That is, since the heat exchanger's temperature Tn is not more than the inlet side water temperature Tw by a value exceeding a prescribed value at time $t_1$, both the multiple heaters 40 and the air supply fan 12 are turned on. If the volume of air of the backwind starts to increase at time $t_2$, the volume of supply of air is reduced by the volume of air of the backwind so that heat exchanger's temperature Tn is decreased. When the volume of air is reduced to reach a lower limit prescribed value We at time $t_3$, the speed of rotation of the fan is increased to reach Nm so that the volume of air reaches the prescribed value Wf. If the volume of air of the backwind is reduced during the time interval between $t_4$ to $t_5$, the volume of supply of air is increased when the volume of air of the backwind is reduced, so that the heat exchanger's temperature Tn is increased. In this case, since the volume of supply of air is increased to reach the upper limit prescribed value Wh, the speed of rotation of the fan is decreased to become Nn so that the volume of supply of air reaches the prescribed value Wf.

Figure 14:
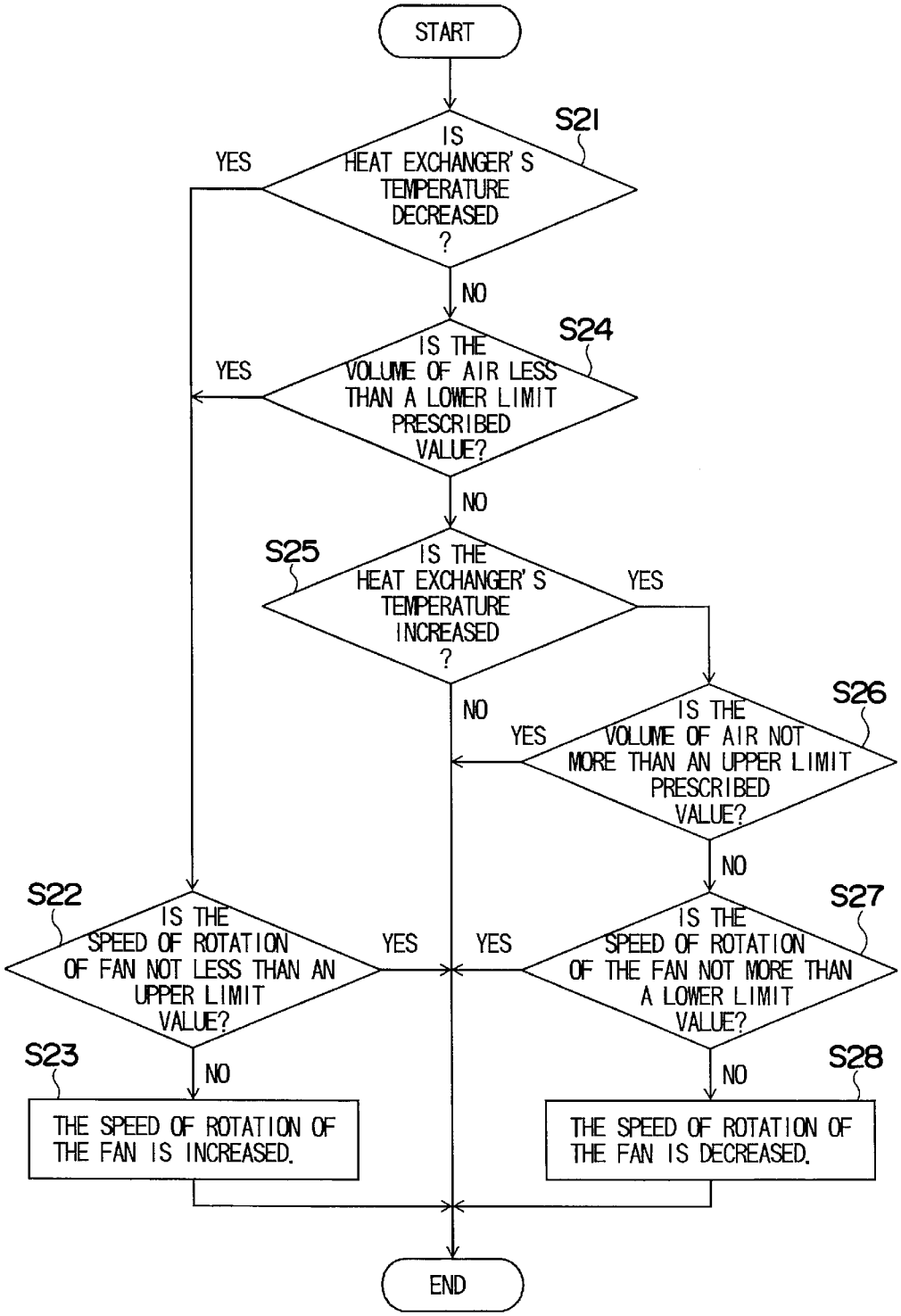
FIG. 14 is a flowchart showing antifreezing operation according to the second embodiment of the invention.

FIG. 14 shows the control of the speed of rotation of the fan by the volume of supply of air in this control, the speed of rotation of the fan motor 62 is varied step by step while detecting a backwind by the air sensor 172 so as to allow an indoor air 10 to flow toward the heat exchanger 14, thereby preventing the heat exchanger 14 from being frozen.

It is decided whether the heat exchanger's temperature Tn is decreased or not based on the temperature detected by the temperature sensor 28 in step S21. If the heat exchanger's temperature Tn is decreased, the program goes to step S22 where it is decided whether the speed of rotation of the fan motor 62 is not less than an upper limit value or not, and if it does not reach the upper limit value, the program goes to step S23 where the speed of the rotation of the fan is increased. That is, if the temperature sensor 28 detects the lowering of the temperature which is not more than by a value exceeding a prescribed value, it is decided that the backwind is increased, thereby increasing the speed of rotation of the fan.

If the heat exchanger's temperature Tn is not decreased in step S21, the program goes to step S24 where it is decided that the volume of air is less than the lower limit prescribed value We or not based on the detected output of the air sensor 172. If the volume of air is less than the lower limit prescribed value We, the program goes to step S22. That is, it is decided that the backwind is increased when detecting the decrease of the volume of air, thereby increasing the speed of rotation of the fan. If the volume of air is not less than lower limit prescribed value We, the program goes to step S25 where it is decided whether the heat exchanger's temperature Tn is increased or not. If the heat exchanger's temperature Tn is not increased, the program goes to step S26 where it is decided the volume of air is not more than the upper limit prescribed value Wh or not based on the detected output of the air sensor 172. That is, if the heat exchanger's temperature Tn is increased and the volume of air is greater than the upper limit prescribed value Wh, it is decided that the backwind is decreased, thereby decreasing the speed of rotation of the fan. For example, the fan motor 62 is rotated at 2700 rpm.

It is decided whether the speed of rotation of the fan is not more than the lower limit value or not in step S27, and if it is more than the lower limit value, the program goes to step S28 where the speed of rotation of the fan is more decreased.

In such a manner, the speed of rotation of the fan can be increased or decreased in response to the condition of the backwind so that the indoor air 10 is allowed to flow toward the heat exchanger 14, thereby preventing the heat exchanger 14 from being frozen.

THIRD EMBODIMENT

Figure 15:
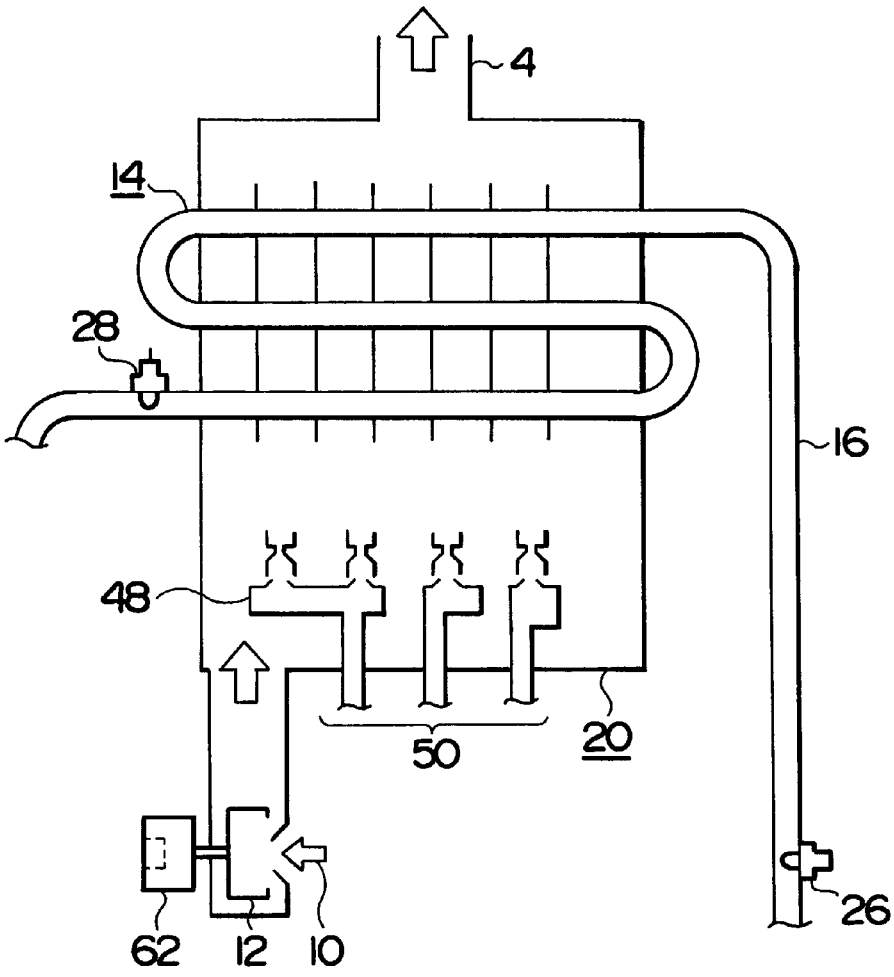
FIG. 15 is a view showing a water heater unit according to a third embodiment of the invention.

FIG. 15 shows a water heater unit according to the third embodiment of the invention. In the third embodiment, the speed of rotation of an air supply fan 12 is increased or decreased using an inlet side water temperature Tw detected by a temperature sensor 26 and a heat exchanger's temperature Tn detected by a temperature sensor 28 respectively installed on a water tube 16 so that both a heat exchanger 14 and the water tube 16 are prevented from being frozen. That is, when the heat exchanger's temperature Tn detected by the temperature sensor 28 approaches a temperature reaching freezing, it is decided that a hot air (indoor air 10) to be used for effecting antifreezing is not sufficient, thereby increasing the speed of rotation of the fan. If the temperature detected by the temperature sensor 28 approaches that of the temperature sensor 26 and is stabilized, it is decided that the volume of hot air is sufficient, thereby decreasing the speed of rotation of the fan.

With the construction of the water heater unit according to the third embodiment of the invention, when a backwind acts on an exhaust tube 4, the heat exchanger's temperature Tn is decreased so that the speed of rotation of the fan is increased while when the backwind is decreased or antifreezing is achieved by the indoor air 10, the speed of rotation of the fan is decreased.

Figure 16:
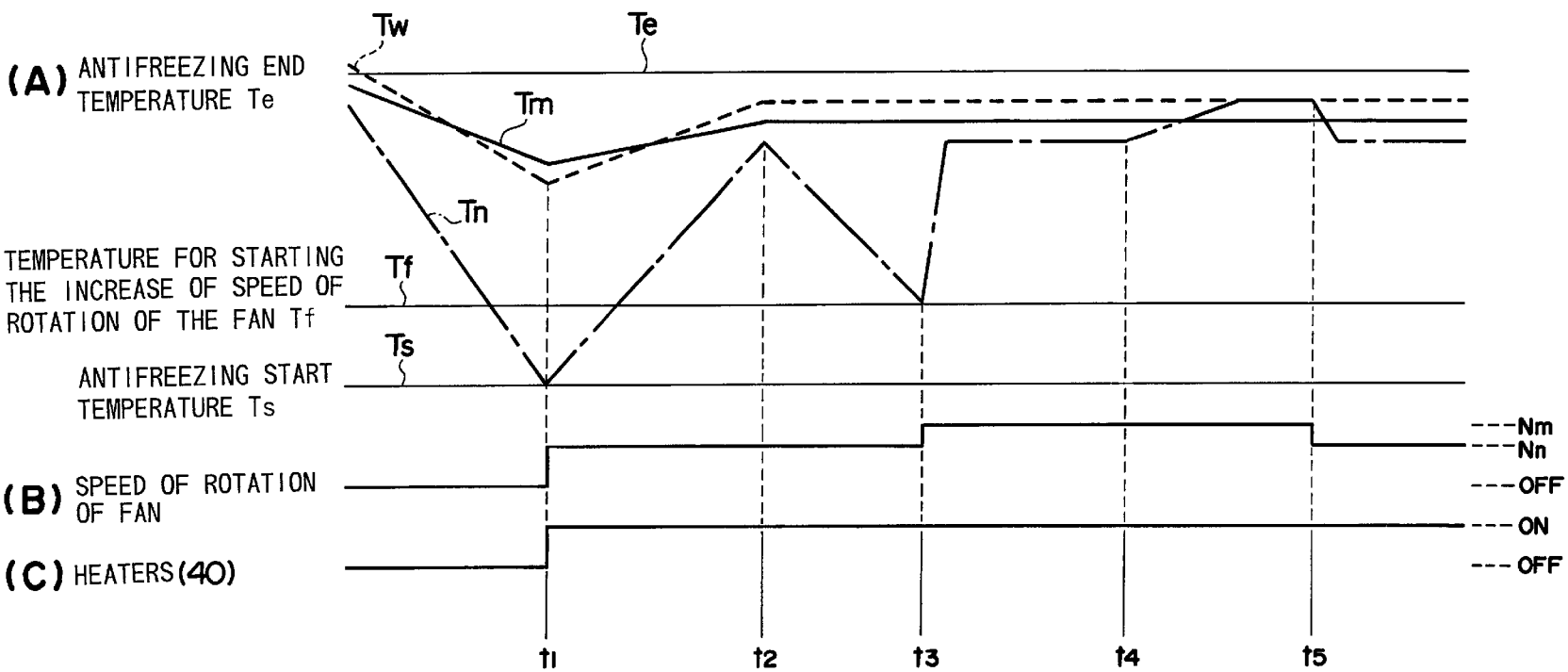
FIG. 16 is a view showing antifreezing operation according to the third embodiment of the invention.

FIG. 16 shows a transition of variation of temperatures during an antifreezing operation. In (A), depicted Tw is an inlet side water temperature, Tm is a temperature of mixture of water and hot water, Tn is a heat exchanger's temperature, Ts is an antifreezing start temperature, Te is an antifreezing end temperature and Tf is temperature for starting the increase of the speed of rotation of the fan. (B) shows switching between the speed of rotations 0, Nn, and Nm(>Nn) of the air supply fan 12, (C) shows ON and OFF states of electric conduction or energization of the multiple heaters 40. That is, since the heat exchanger's temperature Tn is not more than the inlet side water temperature Tw by a value exceeding a prescribed value at time $t_1$, both the multiple heaters 40 and the air supply fan 12 are turned on. Since the volume of backwind becomes large at time $t_2$, the heat exchanger's temperature Tn is decreased. Since the heat exchanger's temperature Tn is decreased by a value exceeding a prescribed value at time $t_3$, the speed of rotation of the fan is increased to reach Nm. Further, the volume of backwind becomes small at time $t_4$, the heat exchanger's temperature Tn is increased. Since the heat exchanger's temperature Tn approaches the inlet side water temperature Tw and is stabilized at time $t_5$, the speed of rotation of the fan is decreased to reach Nn.

Figure 17:
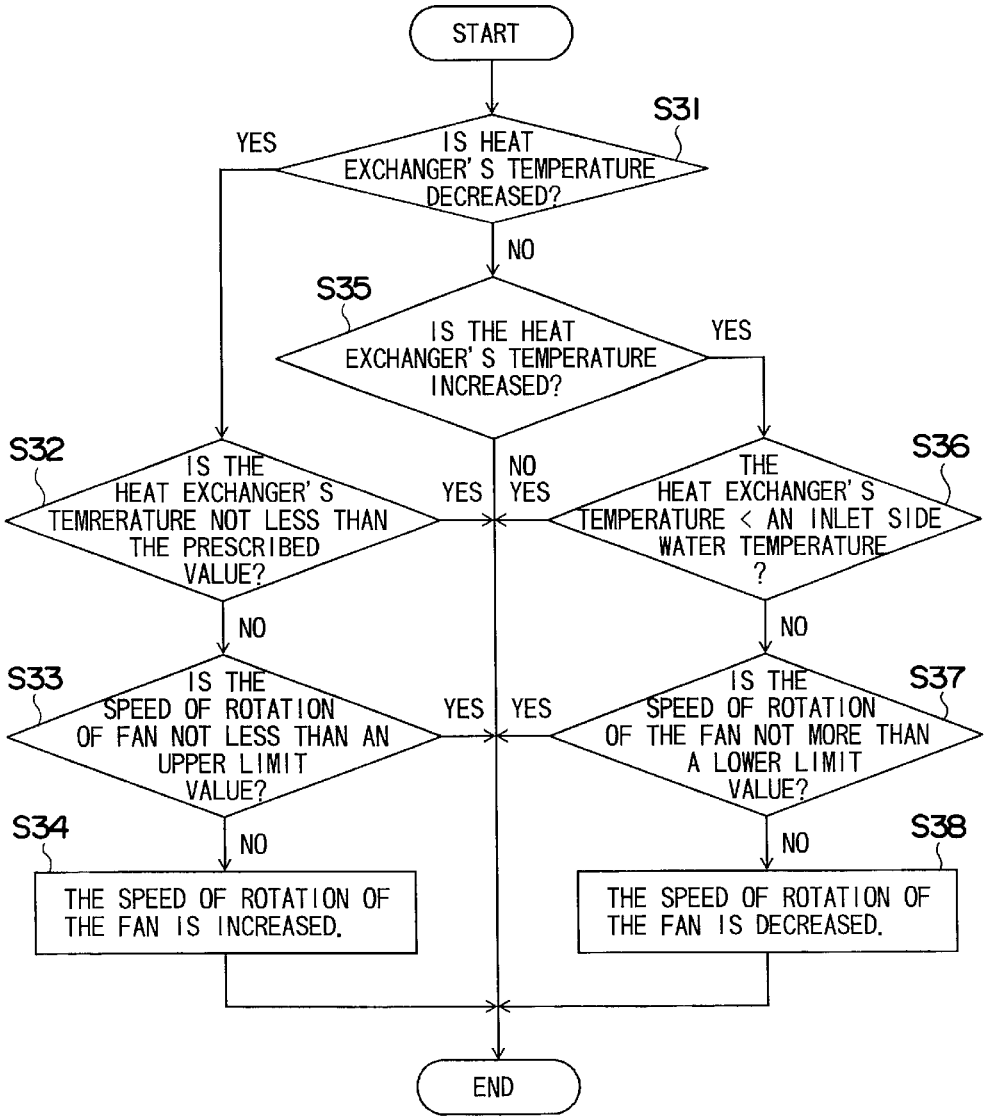
FIG. 17 is a flowchart showing antifreezing operation according to the third embodiment of the invention.

FIG. 17 shows the control of the speed of rotation of the fan by the heat exchanger's temperature Tn. When controlling the speed of rotation of the fan, the speed of rotation of the fan motor 62 is varied step by step while detecting the heat exchanger's temperature Tn, so that the indoor air 10 is allowed to flow toward the heat exchanger 14, thereby preventing the heat exchanger 14 from being frozen.

In step S31, it is decided whether the heat exchanger's temperature Tn is decreased or not based on the temperature detected by the temperature sensor 28 in step S31. When the temperature is decreased, the program goes to step S32, it is decided whether the heat exchanger's temperature Tn is not less than the prescribed value or not, namely, it is decided whether it reaches the temperature for starting the increase of the speed of rotation of the fan or not. If the heat exchanger's temperature Tn is less than the prescribed value, the program goes to step S33 where the speed of rotation of the fan motor 62 is not less than the upper limit value (maximum speed of rotation) or not. When it does not reach the upper limit value, the program goes to step S34 where the speed of rotation of the fan is increased. That is, it is decided that the backwind is increased upon detection of the lowering of temperature by not less than a prescribed value, thereby increasing the speed of rotation of the fan.

If the heat exchanger's temperature Tn is not decreased in step S31, the program goes to step S35 where it is decided whether the heat exchanger's temperature Tn is increased or not. If the heat exchanger's temperature Tn is increased, the program goes to step S36. Then it is decided whether the heat exchanger's temperature Tn is lower than the inlet side water temperature Tw or not, and when the heat exchanger's temperature Tn is higher than the inlet side water temperature Tw, the program goes to step S37 where it is decided whether the speed of rotation of the fan is not more than a lower limit value or not. When the speed of rotation of the fan is more than the lower limit value, the speed of rotation of the fan is decreased in step S38. That is, if the heat exchanger's temperature Tn is increased, and approaches the inlet side water temperature Tw, it is decided that the backwind which blows into the exhaust tube 4 is decreased, thereby decreasing the speed of rotation of the fan.

In such a manner, the speed of rotation of the fan can be increased or decreased in response to the condition of the backwind so that the indoor air 10 is allowed to flow toward the heat exchanger 14, thereby preventing the heat exchanger 14 from being frozen.

FORTH EMBODIMENT

Figure 18:
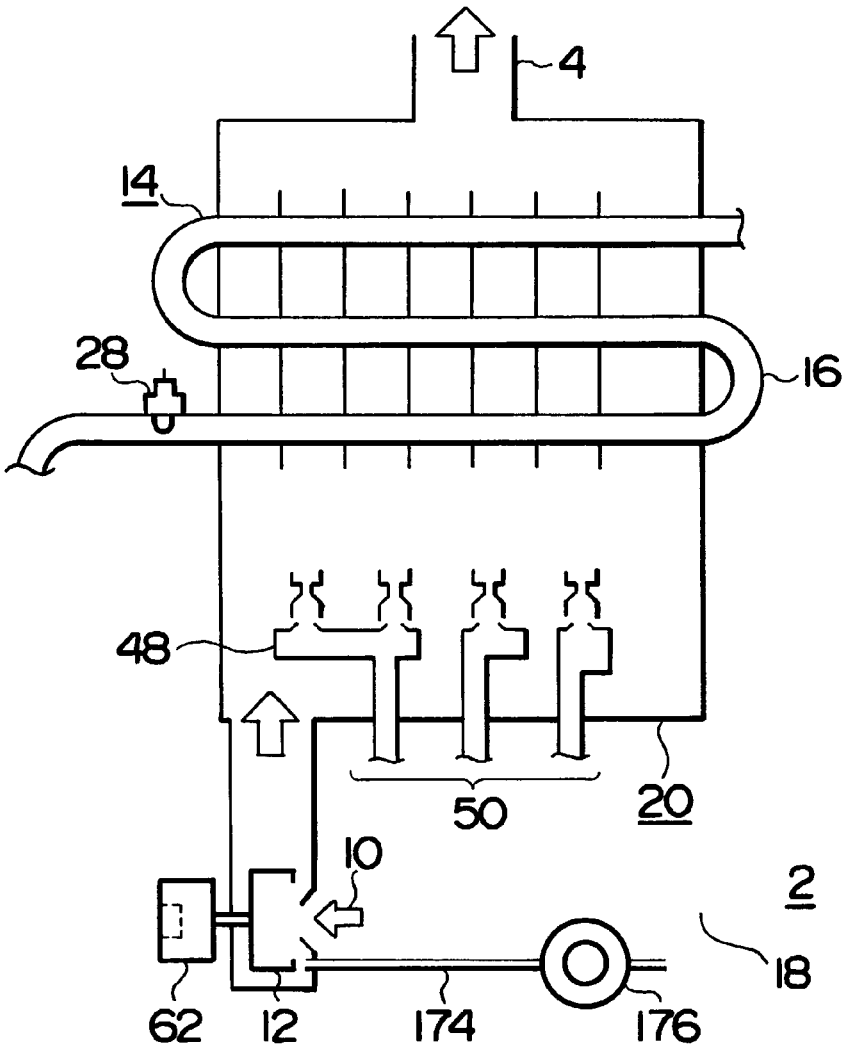
FIG. 18 is a view showing a water heater unit according to a fourth embodiment of the invention.

FIG. 18 shows a water heater unit according to the fourth embodiment of the invention. In the fourth embodiment, a differential pressure detection pipe 174 for detecting the difference of pressures between a pressure inside a housing 18 of a water heater unit 2 and a pressure of a suction part of an air supply fan 12 is provided between the housing 18 and the suction part of the air supply fan 12, and a differential pressure sensor 176 is installed on the differential pressure detection pipe 174. The part for detecting the difference of pressures is specified between the interior of the housing 18 and the suction part of the air supply fan 12, it can be specified other than that between the interior of the housing 18 and the suction part of the air supply fan 12, and also means for detecting difference of the pressures may be other than the differential pressure detection pipe 174.

With the construction of the water heater unit according to the fourth embodiment of the invention, if the back wind acts on the exhaust tube 4 to increase an exhaust load so that a negative pressure acting on the differential pressure sensor 176 is decreased. It is decided that there is a back wind when the negative pressure is decreased so that the speed of rotation of the fan is increased in a manner that the difference of pressures detected by the differential pressure detecting pipe is equal to a predetermined difference of pressures while the speed of rotation of the fan is decreased when the negative pressure is increased.

Figure 19:
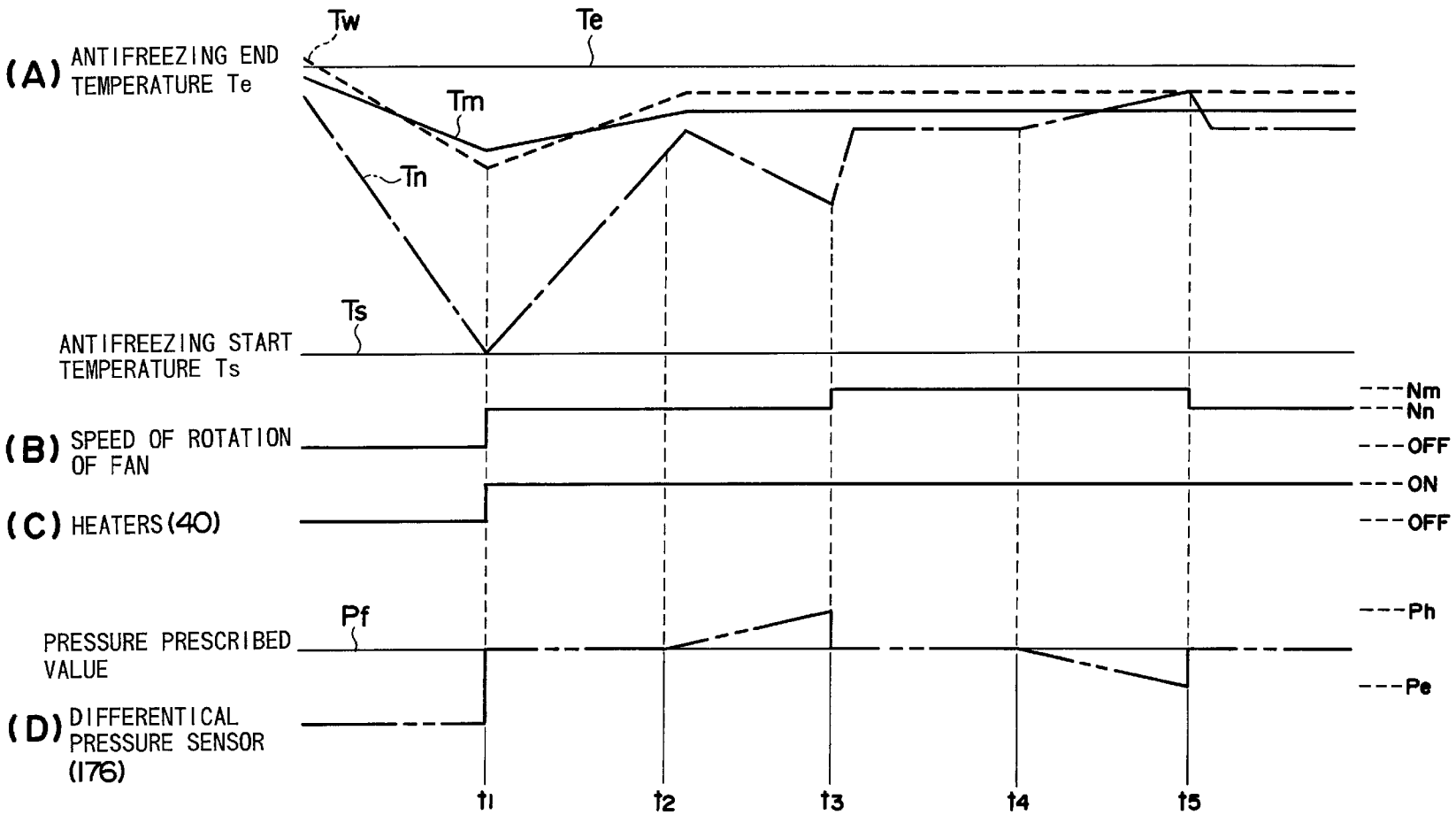
FIG. 19 is a view showing antifreezing operation according to the fourth embodiment of the invention.

FIG. 19 shows a transition of variation of temperatures during an antifreezing operation. In (A), depicted Tw is an inlet side water temperature, Tm is a temperature of mixture of water and hot water, Tn is a heat exchanger's temperature, Ts is an antifreezing start temperature, and Te is an antifreezing end temperature. (B) shows switching between the speed of rotations 0, Nn, and Nm(>Nn) of the air supply fan 12, (C) shows ON and OFF states of electric conduction or energization of the multiple heaters 40. (D) shows a transition of a detected output of the differential pressure sensor 176, wherein depicted by Pf is a pressure prescribed value. That is, since the heat exchanger's temperature Tn is not more than the inlet side water temperature Tw by a value exceeding a prescribed value at time $t_1$, both the multiple heaters 40 and the air supply fan 12 are turned on. When the volume of backwind starts to increase at time $t_2$, the pressure is increased by the volume of backwind so that the heat exchanger's temperature Tn is decreased. When the pressure is increased to reach an upper limit prescribed value Ph at time $t_3$, the speed of rotation N of the fan is increased to reach Nm so that it becomes the pressure prescribed value Pf. Further, since the volume of backwind is decreased at time $t_4$, the pressure is decreased so that the heat exchanger's temperature Tn is increased. Since the pressure is decreased to reach a lower limit prescribed value Pe at time $t_5$, the speed of rotation N of the fan is decreased to reach Nn so that it becomes the pressure prescribed value Pf.

Figure 20:
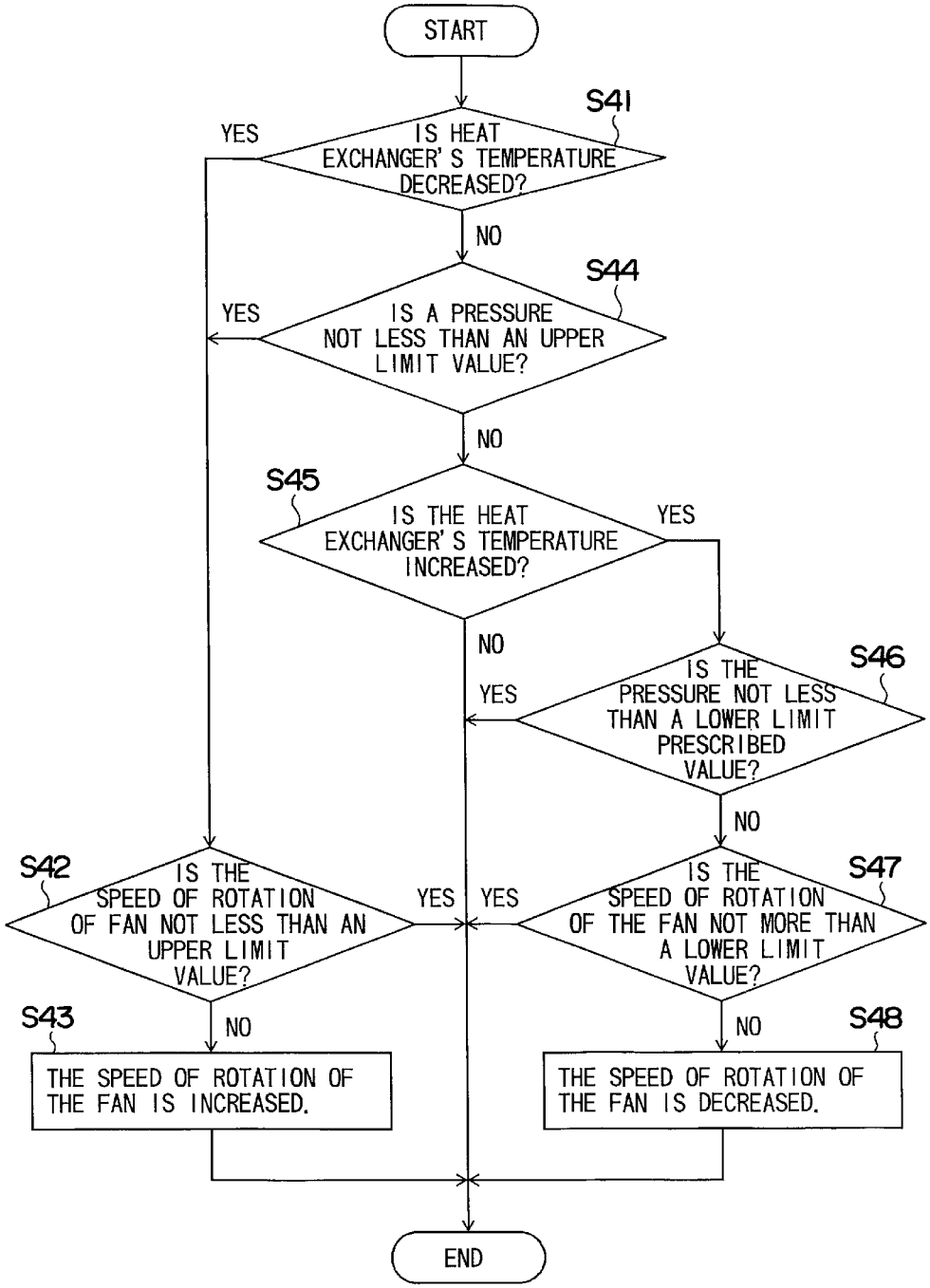
FIG. 20 is a flowchart showing antifreezing operation according to the fourth embodiment of the invention.

FIG. 20 shows the control of the speed of rotation of the fan in response to the magnitude of a pressure. In this control, the strength of the backwind is detected by the differential pressure sensor 176 and the speed of rotation of the fan motor 62 is varied step by step in response to the detected output of the differential pressure sensor 176 so as to allow the indoor air 10 to flow toward the heat exchanger 14, thereby preventing the heat exchanger 14 from being frozen.

It is decided whether the heat exchanger's temperature Tn is decreased or not based on the temperature detected by the temperature sensor 28 in step S41, and when the heat exchanger's temperature Tn is decreased, the program goes to step S42 where it is decided whether the speed of rotation of the fan motor 62 is not less than the upper limit value (maximum speed of rotation) or not. If the speed of rotation of the fan motor 62 does not reach the upper limit value, the program goes to step S43 where the speed of rotation of the fan is increased. That is, if the heat exchanger's temperature Tn is decreased not less than the value exceeding a prescribed value, it is decided that the backwind is increased, thereby increasing the speed of rotation of the fan.

If the heat exchanger's temperature Tn is not decreased in step S41, the program goes to step S44 where it is decided whether the pressure is not less than the upper limit value Ph or not. If the pressure is not less than the upper limit value Ph, the program goes to step S42. In this case, it is decided that the increase of the pressure is the increase of the backwind, thereby increasing the speed of rotation of the fan. If the pressure is not less than the upper limit prescribed value Ph, the program goes to step S45, where it is decided whether the heat exchanger's temperature Tn is increased or not. If the heat exchanger's temperature Tn is increased, the program goes to step S46 where it is decided whether the pressure is not less than the lower limit prescribed value Pe or not. If the pressure is less than the lower limit prescribed value Pe, the program goes to step S47 where the speed of rotation of the fan is decreased. That is, if the heat exchanger's temperature Tn is increased, and the pressure is lower than the prescribed value, it is decided that the backwind is decreased, thereby decreasing the speed of rotation of the fan. The reason why it is decided whether the speed of rotation of the fan is not more than the lower limit value or not in step S47 is to control the speed of rotation of the fan not to reach the minimum speed of rotation.

In such a manner, the speed of rotation of the fan can be increased or decreased by stages in response to the condition of the backwind so that the indoor air 10 is allowed to flow toward the heat exchanger 14, thereby preventing the heat exchanger 14 from being frozen.

FIFTH EMBODIMENT

Figure 21:
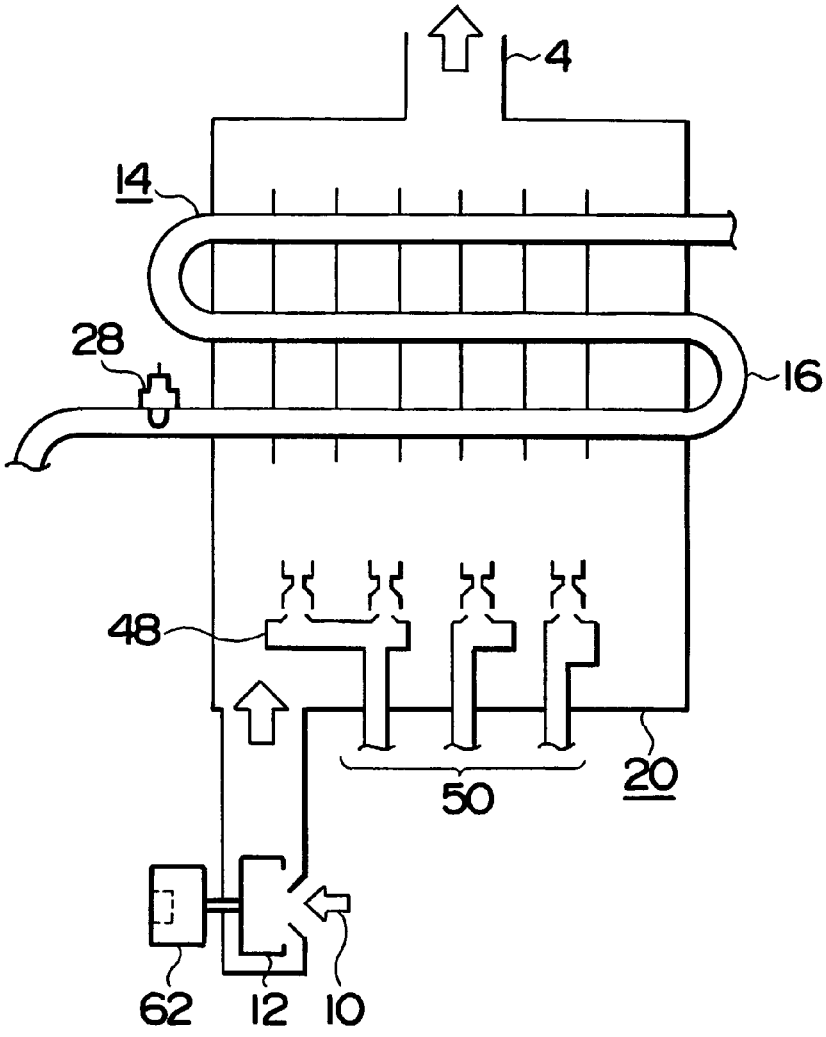
FIG. 21 is a view showing a water heater unit according to a fifth embodiment of the invention.

FIG. 21 shows a water heater unit according to the fifth embodiment of the invention. According to the fifth embodiment, when a backwind acts on an exhaust tube 4 under the condition that a driving voltage of a fan motor 62 is constant and the speed of rotation is also constant, a load applied to the fan motor 62 is decreased, resulting in the decrease of a driving current value of the fan motor 62. At this time, it is decided that there is a backwind and a voltage is controlled to assure a predetermined current value, so as to increase the speed of rotation of the fan motor 62. Further, if the current value is increased, it is decided that the backwind is decreased so that the voltage is controlled to decrease the speed of rotation of the fan motor 62.

Figure 22:
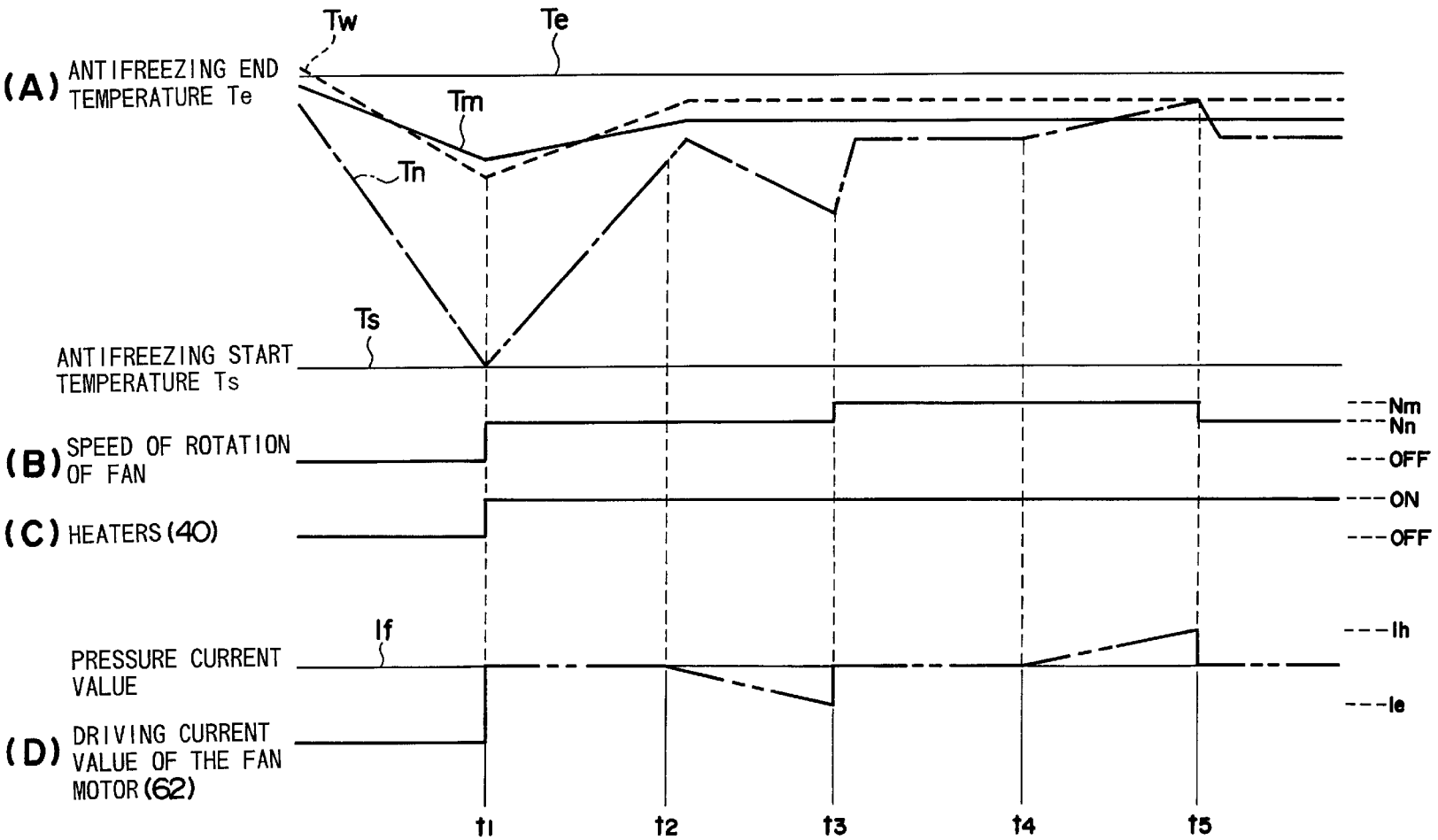
FIG. 22 is a view showing antifreezing operation according to the fifth embodiment of the invention.

FIG. 22 shows a transition of variation of variation of temperatures during an antifreezing operation. In (A), depicted Tw is an inlet side water temperature, Tm is a temperature of mixture of water and hot water, Tn is a heat exchanger's temperature, Ts is an antifreezing start temperature, and Te is an antifreezing end temperature. (B) shows switching between the speed of rotations 0, Nn, and Nm(>Nn) of the air supply fan 12, (C) shows ON and OFF electric conduction or energization of the multiple heaters 40. (D) shows a transition of a driving current value of a fan motor 62, wherein depicted by If is a prescribed current value. That is, since the heat exchanger's temperature Tn is not more than the inlet side water temperature Tw by a value exceeding a prescribed value at time $t_1$, both the multiple heaters 40 and the air supply fan 12 are turned on. When the volume of backwind starts to increase at time $t_2$, the driving current value is decreased by the volume of backwind so that the heat exchanger's temperature Tn is decreased. When the driving current value is decreased to reach a lower limit prescribed current value Ie at time $t_3$, the speed of rotation N of the fan is increased to reach Nm so that it becomes the prescribed current value If. Further, the volume of backwind is decreased at time $t_4$ so that the driving current value is decreased and the heat exchanger's temperature Tn is increased. Since the driving current value is increased to reach an upper limit prescribed value Ih exceeding prescribed value If at time $t_5$, the speed of rotation N of the fan is decreased to reach Nn so that it becomes the prescribed current value If.

Figure 23:
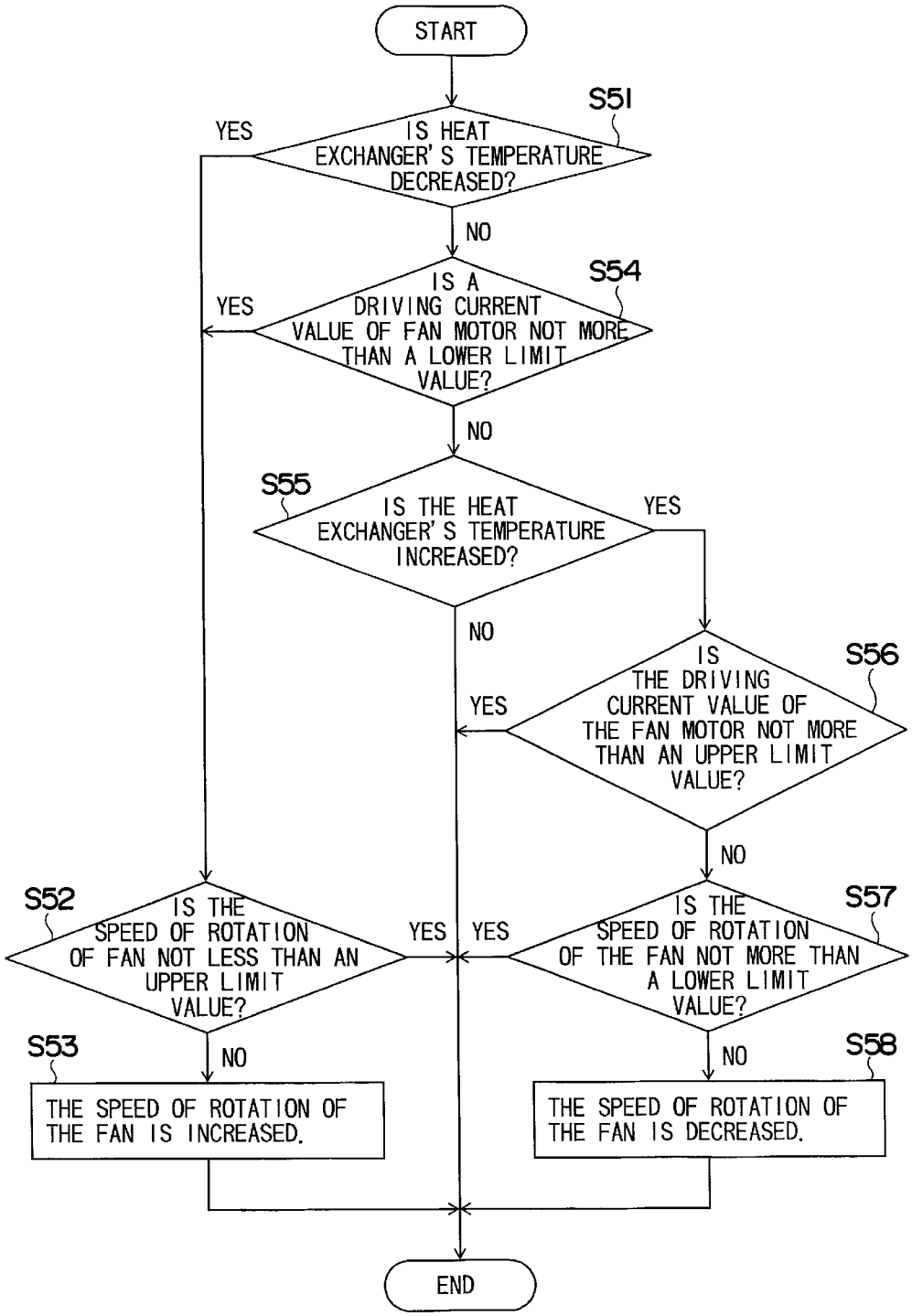
FIG. 23 is a flowchart showing antifreezing operation according to the fifth embodiment of the invention.

FIG. 23 shows the control of rotation of the fan motor 62 by the driving current value of the fan motor 62. Under the control of the rotation of the fan motor 62, the driving current value of the fan motor 62 is detected so as to control the speed of rotation of the fan motor 62 to conform to a prescribed current value. When the backwind becomes strong, a load applied to the fan motor 62 is decreased to decrease the driving current value while the backwind becomes weak, a load applied to the fan motor 62 is increased to increase the driving current value so that the speed of rotation of the fan motor 62 is increased or decreased, thereby preventing both the heat exchanger 14 and the water tube 16 from being frozen.

It is decided whether the heat exchanger's temperature Tn is decreased or not based on the temperature detected by the temperature sensor 28 in step S51, and when the heat exchanger's temperature Tn is decreased, the program goes to step S52 where it is decided whether the speed of rotation of the fan motor 62 is not less than the upper limit value (the maximum speed of rotation) or not. If the speed of rotation of the fan motor 62 does not reach the upper limit value, the program goes to step S53 where the speed of rotation of the fan is increased. That is, if the heat exchanger's temperature Tn is decreased by not less than a prescribed value, it is decided that the backwind is increased, thereby increasing the speed of rotation of the fan.

If the heat exchanger's temperature Tn is not decreased in step S51, the program goes to step S54 where it is decided whether the driving current value of the fan motor 62 is not more than the lower limit value Ie or not. If the driving current value of the fan motor 62 is not more than lower limit value Ie, the program goes to step S52. In this case, it is decided that the increase of the driving current value is the increase of the backwind, thereby increasing the speed of rotation of the fan. Further, if the driving current value is more than the lower limit value Ie, the program goes to step S55, where it is decided whether the heat exchanger's temperature Tn is increased or not. If the heat exchanger's temperature Tn is increased, the program goes to step S56 where it is decided whether the driving current value of the fan motor 62 is not more than the upper limit value Ih or not. If the driving current value is more than the upper limit value Ih, the program goes to step S57 where it is decided whether the speed of rotation of the fan is not more than the lower limit value Ie or not. If the driving current value is more than the lower limit value Ie, it is decided that the backwind is decreased to decrease the speed of rotation of the fan. The reason why it is decided that the speed of rotation of the fan is not more than the lower limit value Ie or not is to control the speed of rotation of the fan not to reach the minimum speed of rotation.

In such a manner, the speed of rotation of the fan can be increased or decreased by stages in response to the condition of the backwind so that the indoor air 10 is allowed to flow toward the heat exchanger 14, thereby preventing the heat exchanger 14 from being frozen.

Although the water heater unit of the invention has been described with reference to the first to fifth embodiments, the invention can be used for re-heating unit, hot water re-heating unit and hot water re-heating air conditioner.

Accordingly, it is possible to prevent a water tube or heat exchanger from being frozen without installing a backwind stopper on an exhaust tube at a cold time, thereby stabilizing the supply of hot water. Further, it is possible to enhance durability of a heater by shortening the time of use of the heater without enhancing ability or performance of the heater.

Although the constructions, operations and effects of the invention have been described with reference to the first to fifth embodiments, the invention is not limited to these five embodiments, and it includes all the constructions which can be estimated and conjectured by a person skilled in the art such as various constructions and modifications which are conjectured by the objects of the invention and the embodiments of the invention.

What is claimed is:

1. A water heater unit comprising:

combustion means for combusting fuel (such as a combustion gas);

a combustion chamber incorporating the combustion means therein and having an exhaust port for guiding combusted exhaust air produced in the combustion chamber to outside air;

a heat exchanger provided with a water tube through which water flows and heating water which flows through the water tube by heat produced by combustion in the combustion means;

temperature sensors attached to the water tube connected to the heat exchanger for detecting temperatures of the water tube; and an air supply fan for supplying air to the combustion chamber in which the combustion means is installed;

wherein the air supply fan is driven to supply air to the combustion chamber when the temperatures detected by the temperature sensors reach a temperature at which freezing of water inside the water tube of the heat exchanger is expected, and the air from the combustion chamber is discharged toward the exhaust port so that the exhaust air warms the water tube.

2. The water heater unit according to claim 1, further comprising a heater installed on the water tube of the heat exchanger for heating the water tube, wherein the heater is energized to heat the water tube when the temperatures detected by the temperature sensors reach a temperature at which freezing of water inside the water tube of the heat exchanger is expected.

3. The water heater unit according to claim 2, wherein the heater heats water inside the water tube when the temperature detected by the temperature sensor for detecting inlet side water temperature reaches a temperature close to a freezing temperature.

4. The water heater unit according to claim 1, wherein when an outlet side water temperature of the water tube detected by the water temperature sensor is lower than the temperature of inlet side water temperature of the water tube detected by the water temperature sensor, the air supply fan is rotated.

5. The water heater unit according to claim 1, further comprising a heater installed on the water tube of the heat exchanger for heating the water tube, and a wind pressure sensor installed at a part capable of detecting a backwind which enters the exhaust port, wherein when the wind pressure sensor detects a backwind exceeding a prescribed value, the air supply fan is stopped and the heater is energized so as to heat the water tube.

6. The water heater unit according to claim 5, wherein the wind pressure sensor is attached to the combustion chamber while intervening a detection member.

7. The water heater unit according to claim 1, wherein the speed of rotation of the air supply fan is increased or decreased in response to the magnitude of a backwind which flows into an exhaust path through the exhaust port.

8. The water heater unit according to claim 1, further comprising an air sensor installed on a part capable of detecting the volume of air which flows into the combustion chamber wherein the volume of air detected by the air sensor is controlled to be equal to a set volume of air by increasing or decreasing the speed of rotation of the air supply fan in response to the volume of air detected by the air sensor.

9. The water heater unit according to claim 8, wherein the air sensor is installed on a bypass provided between an upstream side and a downstream side of the combustion chamber.

10. The water heater unit according to claim 1, further comprising an air sensor installed on a part capable of detecting the volume of air which flows into the combustion chamber wherein the volume of air detected by the air sensor is controlled to be equal to a set volume of air by increasing or decreasing the speed of rotation of the air supply fan in response to the volume of air detected by the air sensor and the temperatures detected by the temperature sensors.

11. The water heater unit according to claim 10, wherein the air sensor is installed on a bypass provided between an upstream side and a downstream side of the combustion chamber.

12. The water heater unit according to claim 1, wherein the speed of rotation of air supply fan is increased or decreased in response to the temperatures detected by the temperature sensors.

13. The water heater unit according to claim 1, further comprising differential pressure detection means installed on a part capable of detecting the difference of pressures between the interior of the housing of the water heater unit and the suction part of the air supply fan, wherein the speed of rotation of the air supply fan is controlled in a manner that the difference of pressures detected by the differential pressure detection means is equal to a predetermined difference of pressures.

14. The water heater unit according to claim 13, wherein the differential pressure detection means is installed between the interior of the housing of the water heater unit and the suction part of the air supply fan.

15. The water heater unit according to claim 1, further comprising differential pressure detection means installed on a part capable of detecting the difference of pressures between the interior of the housing of the water heater unit and the suction part of the air supply fan, wherein the speed of rotation of the air supply fan is controlled in a manner that the difference of pressures detected by the differential pressure detection means is equal to a predetermined difference of pressures in response to the difference of pressures detected by the differential pressure detection means and temperatures detected by the temperature sensors.

16. The water heater unit according to claim 15, wherein the differential pressure detection means is installed between the interior of the housing of the water heater unit and the suction part of the air supply fan.

17. The water heater unit according to claim 1, wherein a load applied to exhaust air is discriminated by a driving current value while a driving voltage of a motor for driving the air supply fan and the speed of rotation of the air supply fan are respectively held constant, and wherein the speed of rotation of the air supply fan is controlled in a manner that it reaches a set current value in response to the load applied to the exhaust air.

18. The water heater unit according to claim 1, wherein a load applied to exhaust air is discriminated by a driving current value while a driving voltage of a motor for driving the air supply fan and the speed of rotation of the air supply fan are respectively constant, and wherein the speed of rotation of the air supply fan is controlled in a manner that it reaches a set current value in response to the load applied to the exhaust air and temperatures detected by the temperature sensors.

* * * * *